US006689553B2

(12) United States Patent
Sakurazawa et al.

(10) Patent No.: US 6,689,553 B2
(45) Date of Patent: Feb. 10, 2004

(54) SILVER HALIDE PHOTOGRAPHIC EMULSION AND SILVER HALIDE PHOTOGRAPHIC LIGHT-SENSITIVE MATERIAL USING THE SAME

(75) Inventors: Mamoru Sakurazawa, Minami-Ashigara (JP); Takeshi Funakubo, Minami-Ashigara (JP); Hirotomo Sasaki, Minami-Ashigara (JP); Kiyoshi Morimoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 45 days.

(21) Appl. No.: 09/795,362

(22) Filed: Mar. 1, 2001

(65) Prior Publication Data

US 2001/0036606 A1 Nov. 1, 2001

(30) Foreign Application Priority Data

Mar. 9, 2000 (JP) ..... 2000-065104

(51) Int. Cl.[7] ..... G03C 1/005

(52) U.S. Cl. ..... 430/567; 430/569; 430/546; 430/551; 430/607; 430/608; 430/628

(58) Field of Search ..... 430/567, 569, 430/546, 551, 607, 608, 628

(56) References Cited

U.S. PATENT DOCUMENTS 4,062,684 A * 12/1977 Hara et al. ..... 430/569
5,017,469 A * 5/1991 Mowforth et al. ..... 430/569
5,491,055 A * 2/1996 Kim ..... 430/567
5,693,459 A * 12/1997 Maskasky ..... 430/567
5,792,602 A * 8/1998 Maskasky et al. ..... 430/569
6,365,336 B1 * 4/2002 Maskasky et al. ..... 430/619
6,383,730 B1 * 5/2002 Maskasky et al. ..... 430/569
6,391,534 B1 * 5/2002 Maskasky et al. ..... 430/567
6,395,465 B1 * 5/2002 Maskasky et al. ..... 430/567
6,518,007 B1 * 2/2003 Reed et al. ..... 430/545

FOREIGN PATENT DOCUMENTS

JP A996883 8/1997
JP A11153840 8/1999

* cited by examiner

*Primary Examiner*—Rosemary Ashton
*Assistant Examiner*—Amanda C. Walke
(74) *Attorney, Agent, or Firm*—Birch, Stewart, Kolasch & Birch, LLP

(57) ABSTRACT

A silver halide photographic emulsion that comprises silver halide grains. The emulsion was prepared in the presence of at least one halogen oxoacid salt represented by formula (I) below:

$$M(XO_n)_m \quad (I)$$

wherein M represents an alkali metal ion or alkaline-earth metal ion, X represents a halogen atom, n represents 2 or 3, and m represents 1 or 2. A silver halide photographic light-sensitive material that has at least one silver halide emulsion layer on a support. The material contains the above silver halide photographic emulsion.

16 Claims, No Drawings

SILVER HALIDE PHOTOGRAPHIC EMULSION AND SILVER HALIDE PHOTOGRAPHIC LIGHT-SENSITIVE MATERIAL USING THE SAME

CROSS-REFERENCE TO RELATED APPLICATIONS

This application is based upon and claims the benefit of priority from the prior Japanese Patent Application No. 2000-065104, filed Mar. 9, 2000, the entire contents of which are incorporated herein by reference.

BACKGROUND OF THE INVENTION

The present invention relates to a silver halide photographic emulsion and, more particularly, to a silver halide photographic emulsion containing silver halide grains by which deterioration by oxygen is improved, and a silver halide photographic light-sensitive material containing the emulsion.

In silver halide photographic emulsions, improving the sensitivity/graininess ratio is the most important object.

As a method of improving the sensitivity/graininess ratio of a silver halide photographic emulsion, the use of tabular grains which increase the efficiency of light absorption is known in, e.g., U.S. Pat. No. 4,956,269. The sensitivity can be improved by increasing the aspect ratio of such tabular grains and increasing the amount of a spectral sensitizing dye. Reduction sensitization is also known as a method of increasing the grain sensitivity.

Improving the sensitivity, however, often lowers the resistance against deterioration of a light-sensitive material during storage. In particular, oxygen participates in an increase in fog during storage, so it is strongly desired to improve this fog increase.

As a method of improving the fog increase caused by oxygen, it is possible to use a radical scavenger which deactivates oxygen or organic radicals generated in a light-sensitive material by oxygen. Examples are phenol-based compounds described in, e.g., Jpn. Pat. Appln. KOKAI PUBLICATION No. (hereinafter referred to as JP-A-)7-72599 and hydroxyamine-based compounds represented by, e.g., formulas (A-I) to (A-III) described in JP-A-8-76311 and U.S. Pat. No. 5,719,007, formula (S2) described in JP-A-10-10668, formula (S1) described in JP-A-11-15102, and formula (S1) described in JP-A-10-90819.

JP-A's-9-96883 and 11-153840 have disclosed methods of preparing tabular grains in the presence of an oxidizer for silver, but do not predict a reduction of fog by a halogen oxoacid salt of the present invention. Also, Jpn. Pat. Appln. KOKOKU PUBLICATION No. (hereinafter referred to as JP-B-)52-14625 has disclosed a method of intensifying dye images in the presence of a chlorite. However, unlike the present invention JP-B-52-14625 does not describe any method of using the chlorite during the preparation of emulsions.

BRIEF SUMMARY OF THE INVENTION

It is an object of the present invention to provide a silver halide emulsion in which changes in fog caused by oxygen during storage are significantly improved without lowering the sensitivity, and a silver halide photographic light-sensitive material containing the emulsion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present inventors made extensive studies and have found a means for maintaining improved sensitivity and suppressing an increase in fog by oxygen. Specifically, the present inventors have found a means to previously remove fine silver nuclei, which exist on the surface or in the interior of an emulsion grain and presumably cause oxygen fog, by the use of an oxidizer.

That is, the object of the present invention is achieved by silver halide photographic emulsions described below and a silver halide photographic light-sensitive material using the emulsions.

(1) A silver halide photographic emulsion comprising silver halide grains, wherein the emulsion was prepared in the presence of at least one halogen oxoacid salt represented by formula (I) below:

$$M(XO_n)_m \qquad \text{Formula (I)}$$

wherein M represents an alkali metal ion or alkaline-earth metal ion, x represents a halogen atom, n represents 2 or 3, and m represents 1 or 2.

(2) The silver halide photographic emulsion described in item (1) above, wherein the halogen oxoacid salt is chlorite.

(3) The silver halide photographic emulsion described in item (1) or (2) above, wherein 50% or more of the total projected area of all the silver halide grains contained in the emulsion is occupied by tabular silver halide grains, each having (111) faces as parallel main planes and an aspect ration of 5 or more.

(4) The silver halide photographic emulsion described in any one of items (1) to (3) above, wherein the emulsion was reduction sensitized by at least one reduction sensitizer selected from a group consisting of (a) thiourea dioxide, (b) hydroxyamines and their derivatives, and (c) dihydroxybenzenes and their derivatives.

(5) A silver halide photographic light-sensitive material having at least one silver halide emulsion layer on a support, wherein the silver halide photographic emulsion described in any one of items (1) to (4) above is contained in the at least one silver halide emulsion layer.

The present invention will be described in detail below.

First, details of a halogen oxoacid salt represented by formula (I) will be described.

The halogen atom represented by X is preferably chlorine, bromine, or iodine, and more preferably, chlorine. The halogen oxoacid salt is preferably chlorite, bromate, or iodate, and most preferably, chlorite.

The alkali metal ion or alkaline-earth metal ion represented by M is preferably a potassium ion, sodium ion, magnesium ion, or calcium ion, and more preferably, a sodium ion.

Practical examples of a halogen oxoacid salt defined in the present invention are sodium chlorite, potassium chlorite, potassium iodate, and sodium bromate. However, the present invention is not limited to these examples.

The halogen oxoacid salt can be used in any one of silver halide grain emulsion preparing steps. The halogen oxoacid salt can be added once or can be added two or more times separately during the emulsion preparing steps. The halogen oxoacid salt preferably be added once or more times during the preparing process that is selected from during silver halide grain formation, after silver halide grain formation and before the start of a desilvering step, during the desilvering step, before the start of chemical ripening, and during the chemical ripening step. The halogen oxoacid salt is more preferably added at least once during the emulsion preparing process that is selected from during grain formation and before the start of chemical ripening, during the chemical ripening step, and after the completion of the chemical ripening. When a silver halide emulsion is to be reduction-sensitized by using a reducing agent as will be described later, the halogen oxoacid salt is preferably added. It is unpreferable to add the halogen oxoacid salt when a coating solution is prepared using a silver halide emulsion already chemically ripened after grain formation, because the effect of the present invention is impaired.

The concentration of the halogen oxoacid salt in a step in which it is used is preferably $1\times10^{-6}$ to $1\times10^{-3}$ mol, and more preferably, $5\times10^{-6}$ to $2\times10^{-4}$ mol per mol of silver halide.

Two or more types of the halogen oxoacid salts can be used together.

The halogen oxoacid salt is preferably added in the form of an aqueous solution or aqueous gelatin solution. When the halogen oxoacid salt is used as an aqueous solution, the pH is preferably adjusted by a known buffering agent. The pH is preferably 6 to 10, and more preferably, 7 to 9.5.

Silver halide emulsion of the present invention will be described in detail below.

Silver halide grains contained in the emulsion of the present invention have regular crystals such as cubic, octahedral, or tetradecahedral crystals, irregular crystals such as spherical or tabular crystals, crystals having crystal defects such as twin planes, or composite shapes thereof. Silver halide grain emulsions are particularly preferably tabular grains.

In the photographic emulsion of the invention, 50% or more of the total projected area are preferably accounted for by tabular grains, each having an aspect ratio of 5 or more (hereinafter, this emulsion is also referred to as "tabular grain emulsion"). The projected area and aspect ratio of a tabular grain can be measured from an electron micrograph obtained by shadowing the tabular grain together with a reference latex sphere by using a carbon replica method. When viewed in a direction perpendicular to the main planes, a tabular grain commonly has the shape of a hexagon, triangle, or circle. The aspect ratio is the value obtained by dividing the diameter (equivalent-circle diameter) of a circle having an area equal to the projected area of a tabular grain by the thickness of the grain. As the shape of a tabular grain, the ratio of hexagons is preferably as high as possible. Also, the ratio of the lengths of adjacent sides of the hexagon is preferably 1:2 or less.

The higher the aspect ratio, the more remarkable the effect of the present invention. Therefore, in the photographic emulsion of the invention, it is more preferable that 50% or more of the total projected area are accounted for by tabular grains having an aspect ratio of 8 or more, and more preferably, 12 or more. If the aspect ratio is too high, however, the variation coefficient of the grain size distribution increases. Therefore, an aspect ratio of 50 or less is usually preferred.

The average grain diameter of silver halide grains contained in the emulsion of the present invention is preferably 0.2 to 10.0 $\mu$m, and more preferably, 0.5 to 5.0 $\mu$m as an average equivalent-circle diameter. The equivalent-circle diameter is the diameter of a circle having an area equal to the projected area of the parallel main planes of a grain. The projected area of a grain can be obtained by measuring the area on an electron micrograph and correcting the photographing magnification. The average equivalent-sphere diameter is preferably 0.1 to 5.0 $\mu$m, and more preferably, 0.6 to 2.0 $\mu$m. In these ranges, the sensitivity/graininess ratio of a photographic emulsion is highest. The average thickness of tabular grains is preferably 0.05 to 1.0 $\mu$m. The average equivalent-circle diameter is the average value of the equivalent-circle diameters of 1,000 or more grains randomly sampled from a homogeneous emulsion. The same can be applied to the average thickness.

The grain size distribution of silver halide grains contained in the emulsion of the present invention can be either monodisperse or polydisperse, but is preferably monodisperse.

The tabular grain is preferably composed of opposing (111) main planes and side faces connecting these main planes. At least one twin plane preferably exists between the main planes. In a tabular grain used in the present invention, two twin planes are preferably observed. As described in U.S. Pat. No. 5,219,720, the spacing between these two twin planes can be decreased to less than 0.012 $\mu$m. Also, as described in JP-A-5-249585, the value obtained by dividing the distance between the (111) main planes by the twin plane spacing can be increased to 15 or more.

In the present invention, 75% or less of all side faces connecting the opposing (111) main planes of the tabular grain are particularly preferably constituted by (111) faces. "75% or less of all side faces are constituted by (111) faces" means that in a tabular grain, crystallographic faces other than (111) faces exist at a ratio higher than 25% of all side faces. It is generally understood that this face is a (100) face, but some other face such as a (110) face or a higher-index face also can exist. The effect of the present invention is more remarkable when 70% or less of all side faces are constituted by (111) faces.

Whether 70% or less of all side faces are constituted by (111) faces can be readily determined from a shadowed electron micrograph of the tabular grain obtained by a carbon replica method. When 75% or more of side faces are constituted by (111) faces in a hexagonal tabular grain, six side faces directly connecting to the (111) main planes alternately connect at acute and obtuse angles to the (111) main planes. On the other hand, when 70% or less of all side faces are constituted by (111) faces in a hexagonal tabular grain, all six side faces directly connecting to the (111) main planes connect at obtuse angles to the (111) main planes. By performing shadowing at an angle of 500 or less, it is possible to distinguish between obtuse and acute angles of side faces with respect to the main planes. Shadowing at an angle of preferably 10° to 30° facilitates distinguishing between obtuse and acute angles.

A method using adsorption of sensitizing dyes is also effective to obtain the ratio of (111) faces to (100) faces. The ratio of (111) faces to (100) faces can be quantitatively obtained by using a method described in Journal of Japan Chemical Society, 1984, Vol. 6, pp. 942 to 947. By using this ratio and the equivalent-circle diameter and thickness of a tabular grain, it is possible to calculate the ratio of (111) faces in all side faces. In this case it is assumed that a tabular grain is a circular cylinder and the use is made of the equivalent-circle diameter and thickness. On the basis of this assumption, the ratio of side faces to the total surface area can be obtained. The value obtained by dividing the ratio of (100) faces, which is obtained by adsorption of sensitizing dyes as described above, by the ratio of side faces and multiplying the quotient by 100 is the ratio of (100) faces in all side faces. By subtracting this value from 100, the ratio of (111) faces in all side faces can be calculated. In the present invention, the ratio of (111) faces in all side faces is more preferably 65% or less.

A method by which 75% or less of all side faces of the tabular grain of the present invention are constituted by (111) faces will be described below. Most generally, the ratio of (111) faces in side faces of a silver iodobromide or silver bromochloroiodide tabular grain can be determined by the pBr during the preparation of the tabular grain emulsion. The pBr is the logarithm of the reciprocal of the $Br^-$ ion concentration of a system. The pBr is preferably so set that, assuming the total silver amount of a tabular grain emulsion is 100, the ratio of (111) faces in side faces decreases, i.e., the ratio of (100) faces in side faces increases, after at least 70% of the total silver amount are added. The pBr is most preferably so set that the ratio of (100) faces in side faces increases after at least 90% of the total silver amount are added.

If the pBr is so set that the ratio of (100) faces in side faces increases before 70% of the total silver amount are added, the aspect ratio of a tabular grain undesirably lowers. If the pBr is so set that the ratio of (100) faces in side faces increases after 98% or more of the total silver amount are added, it becomes difficult to achieve the (100) face ratio in side faces by which the effect of the present invention is obtained. Accordingly, the effect of the present invention is most remarkably obtained when the pBr is so set that the ratio of (100) faces in side faces increases after at least 90% of the total silver amount are added and before 98% or more of the total silver amount are added. However, as another method it is also possible to increase the ratio of (100) faces in side faces by performing ripening by setting the pBr such that the ratio of (100) faces in side faces increases after the total silver amount is added.

The value of the pBr by which the ratio of (100) faces in side faces increases can vary over a broad range in accordance with the temperature and pH of the system, the type and concentration of a protective colloid agent such as gelatin, and the presence/absence, type, and concentration of a silver halide solvent. Usually, the pBr is preferably 2.0 to 5, and more preferably, 2.5 to 4.5. As described above, however, the value of the pBr can easily change owing to, e.g., the presence of a silver halide solvent. Hence, no silver halide solvent is preferably used in the present invention.

Examples of the silver halide solvent usable in the present invention are (a) organic thioethers described in, e.g., U.S. Pat. Nos. 3,271,157, 3,531,289, and 3,574,628, and JP-A's-54-1019 and 54-158917, (b) thiourea derivatives described in, e.g., JP-A's-53-82408, 55-77737, and 55-2982, (c) a silver halide solvent having a thiocarbonyl group sandwiched between an oxygen or sulfur atom and a nitrogen atom described in JP-A-53-144319, (d) imidazoles described in JP-A-54-100717, all the disclosures of which are incorporated herein by reference (e) ammonia, and (f) thiocyanate.

Particularly preferable solvents are thiocyanate, ammonia, and tetramethylthiourea. Although the amount of a solvent used changes in accordance with the type of the solvent, a preferred amount of, e.g., thiocyanate is $1\times10^{-4}$ to $1\times10^{-2}$ mol per mol of a silver halide.

EP515894A1, the disclosure of which is incorporated herewith by reference, and the like can be referred to as a method of changing the face index of a side face of a tabular grain emulsion. Also, polyalkyleneoxide compounds described in, e.g., U.S. Pat. No. 5,252,453, the disclosure of which is incorporated herewith by reference, can be used. It is effective to use face index modifiers described in, e.g., U.S. Pat. Nos. 4,680,254, 4,680,255, 4,680,256, and 4,684,607, the disclosures of which are incorporated herewith by reference. Common photographic spectral sensitizing dyes also can be used as face index modifiers.

In the present invention, the tabular grain emulsion can be prepared by diverse methods as long as the aforesaid required conditions are met. The preparation of the tabular grain emulsion basically includes three steps of nucleation, ripening, and growth. In the nucleation step of the tabular grain emulsion of the present invention, it is extremely effective to use gelatin having a small methionine content described in U.S. Pat. Nos. 4,713,320 and 4,942,120, perform nucleation at high pBr described in U.S. Pat. No. 4,914,014, and perform nucleation within short time periods described in JP-A-2-222940, the disclosures of which are incorporated herewith by reference. In the ripening step of the tabular grain emulsion of the present invention, it is sometimes effective to perform ripening in the presence of a low-concentration base described in U.S. Pat. No. 5,254,453 and perform ripening at high pH described in U.S. Pat. No. 5,013,641, the disclosures of which are incorporated herewith by reference. In the growth step of the tabular grain emulsion of the present invention, it is particularly effective to perform growth at low temperature described in U.S. Pat. No. 5,248,587 and use fine silver iodide grains described in U.S. Pat. Nos. 4,672,027 and 4,693,964, the disclosures of which are incorporated herewith by reference. Additionally, it is preferable to perform growth by adding silver bromide, silver iodobromide, and silver bromochloroiodide fine grain emulsions, thereby effect ripening. It is also possible to supply these fine grain emulsions by using a stirring device described in JP-A-10-43570.

In the emulsions of the present invention, it is preferable to introduce positive hole capturing silver nuclei by intentional reduction sensitization. "Intentional reduction sensitization" means reduction sensitization performed by adding a reduction sensitizer. A positive hole capturing silver nucleus is a small silver nucleus having a little development activity. This silver nucleus can prevent recombination loss in the exposure step and increase the sensitivity. Positive hole capturing silver nuclei can be introduced by performing intentional reduction sensitization during the formation of silver halide emulsion grains.

As the reduction sensitizer, stannous chloride, ascorbic acid and its derivatives, amines and polyamines, hydrazine derivatives, thiourea dioxide, silane compounds, borane compounds, dihydroxybenzenes and their derivatives, and hydroxyamines and their derivatives are effective. In reduction sensitization performed for the emulsion of the present invention, it is possible to selectively use these reduction sensitizers or to use two or more types of compounds together. Preferred reduction sensitizers in the present invention are thiourea dioxide, hydroxyamines and their derivatives, and dihydroxybenzenes and their derivatives. Although the addition amount of reduction sensitizers must be so selected as to meet the emulsion preparing conditions, a proper amount is $10^{-7}$ to $10^{-}$mol per mol of a silver halide.

Reduction sensitizers are dissolved in water or a solvent, such as alcohols, glycols, ketones, esters, or amides, and the resultant solution is added during grain growth.

In the present invention, positive hole capturing silver nuclei are preferably formed by adding reduction sensitizers after 50% of the total silver amount required for grain formation are added. More preferably, positive hole capturing silver nuclei are formed by adding reduction sensitizers after 70% of the total silver amount required for grain formation are added. In the present invention, positive hole capturing silver nuclei can also be formed at the surface of the grain by adding reduction sensitizers after grain formation is completed.

When reduction sensitizers are added during grain formation, some silver nuclei formed can stay inside a grain, but some ooze out to form silver nuclei on the grain surface. In the present invention, these oozing silver nuclei are preferably used as positive hole capturing silver nuclei.

The dihydroxybenzenes and their derivatives that are preferable as a reduction sensitizer are compounds represented by general formula (V-1) and/or compounds represented by general formula (V-2) below:

(V-1)

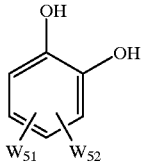

(V-2)

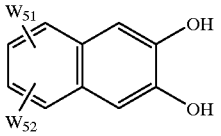

In formulas (V-1) and (V-2), each of $W_{51}$ and $W_{52}$ independently represents a sulfo group or hydrogen atom. However, at least one of $W_{51}$ and $W_{52}$ represents a sulfo group. A sulfo group is generally an alkali metal salt such as sodium or potassium or a water-soluble salt such as ammonium salt. Favorable practical examples are disodium 4,5-dihydroxybenzene-1,3-disulfonate, 4-sulfocatechol ammonium salt, 2,3-dihydroxy-7-sulfonaphthalene sodium salt, and 2,3-dihydroxy-6,7-disulfonaphthalene potassium salt. Most preferable compound is disodium 4,5-dihydroxybenzene-1,3-disulfonate. A preferred addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is preferably 0.0005 to 0.5 mol, and more preferably, 0.003 to 0.05 mol per mol of a silver halide.

The hydroxyamines and their derivatives that are preferable for a reduction sensitizer is represented by general formula (A) below:

$$Ra—N(Rb)OH \quad (A)$$

In the formula (A), Ra represents an alkyl group, alkenyl group, aryl group, acyl group, carbamoyl group, sulfamoyl group, alkoxycarbonyl group, aryloxycarbonyl group or hetero cyclic group; and Rb represents a hydrogen atom or one of the groups represented by Ra.

Ra may be further substituted by at least one substituent. Examples of the substituent are an alkyl group, alkenyl group, aryl group, hetero cyclic group, hydroxy group, alkoxy group, aryloxy group, alkylthio group, arylthio group, amino group, acylamino group, sulfonamide group, alkylamino group, arylamino group, carbamoyl group, sulfamoyl group, sulfo group, carboxyl group, halogen atom, cyano group, nitro group, sulfonyl group, acyl group, alkoxycarbonyl group, aryloxy carbonyl group, acyloxy group, and hydroxylamine group. Ra is preferably a hetero cyclic group, for example, 1,3,5-triazine-2-yl, 1,2,4-triazine-3-yl, pyridine-2-yl, pyrazinyl, pyrimidinyl, purinyl, quinolyl, imidazolyl, thiazolyl, oxazoly, 1,2,4-triazol-3-yl, benzimidazol-2-yl, benzothiazolyl, benzoxyazolyl, thienyl, furyl, imidazolydinyl, pyrolinyl, tetrahydrofuryl, morpholinyl, and phosphinophosphorous-2-yl.

Rb is preferably a hydrogen atom or an alkyl group, more preferably a hydrogen atom or a methyl group.

Practical examples of the compounds represented by general formula (A) are those of RS-I to RS-X set forth below, however, the hydroxyamines and their derivatives that can be used in the present invention are not limited to these:

RS-I

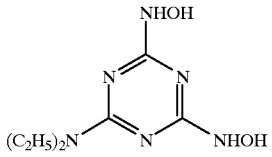

RS-II

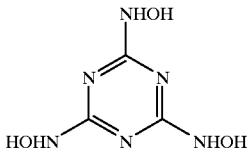

RS-III

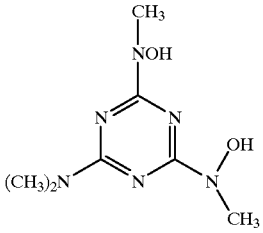

RS-IV

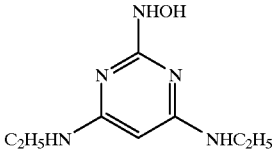

RS-V

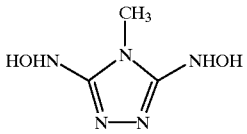

RS-VI

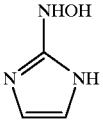

RS-VII

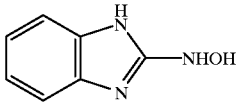

-continued

RS-VIII

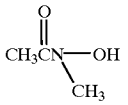

RS-IX

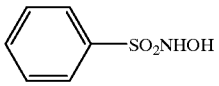

RS-X

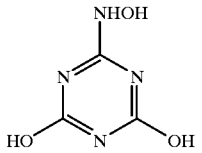

An emulsion of the present invention is preferably silver iodobromide, silver iodochloride, silver chlorobromide, or silver bromochloroiodide, and more preferably, silver iodobromide or silver bromochloroiodide. Silver bromochloroiodide can contain silver chloride, and the silver chloride content is preferably 8 mol % or less, and more preferably, 3 to 0 mol %. The silver iodide content is preferably 20 mol % or less because the variation coefficient of the grain size distribution is favorably 25% or less. Lowering the silver iodide content facilitates decreasing the variation coefficient of the grain size distribution of a tabular grain emulsion. It is particularly preferable that the variation coefficient of the grain size distribution of a tabular grain emulsion be 20% or less and the silver iodide content be 10 mol % or less. The variation coefficient of the silver iodide content between grains is preferably 20% or less, and particularly preferably, 10% or less, regardless of the silver iodide content.

An emulsion of the present invention preferably has a structure with respect to the silver iodide distribution in a grain. This structure of the silver iodide distribution can be a double structure, triple structure, quadruple structure, or higher-order structure.

The silver iodide content on the grain surface of an emulsion of the present invention is preferably 10 mol % or less, and more preferably, 5 mol % or less. The silver iodide content on the grain surface defined in the present invention is measured by using XPS (X-ray Photoelectron Spectroscopy). The principle of XPS used in the analysis of the silver iodide content near the surface of a silver halide grain is described in Aihara et al., "Spectra of Electrons" (Kyoritsu Library 16: issued Showa 53 by Kyoritsu Shuppan). A standard measurement method of XPS is to use Mg-Kα as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed by, e.g., proteinase and removed. A tabular grain emulsion used in the present invention in which the silver iodide content on the grain surface is 5 mol % or less is an emulsion whose silver iodide content is 5 mol % or less when emulsion grains contained in the emulsion are analyzed by XPS. If obviously two or more types of emulsions are mixed, appropriate preprocessing such as centrifugal separation or filtration must be performed before one type of emulsion is analyzed.

The structure of an emulsion of the present invention is preferably a triple structure including silver bromide/silver iodobromide/silver bromide or a higher-order structure. The boundary of the silver iodide content between layers of the structure can be a distinct boundary or can continuously moderately change. In the measurement of the silver iodide content using a powder X-ray diffraction method, the silver iodide content does not have two distinct peaks but shows an X-ray diffraction profile having a tail in the direction of a high silver iodide content.

In the present invention, the silver iodide content of a phase inside the surface is preferably higher than the silver iodide content on the surface. This silver iodide content of a phase inside the surface is higher, preferably by 5 mol % or more, and more preferably, by 7 mol % or more.

Emulsion grains of the present invention are preferably spectrally sensitized by a known cyanine dye. Although the cyanine sensitizing dye can be added in any step of the emulsion preparing process, spectral sensitization is preferably performed by adding the cyanine dye during or before chemical sensitization.

An example of a cyanine dye useful in the present invention is a dye represented by formula (II):

An example of a cyanine dye useful in the present invention is a dye represented by formula (II):

(II)

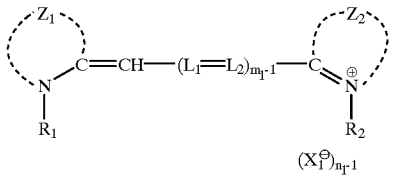

wherein each of $Z_1$ and $Z_2$ independently represents an atomic group necessary to form a heterocyclic nucleus commonly used in a cyanine dye. Examples are thiazole, thiazoline, benzothiazole, naphthothiazole, oxazole, oxazoline, benzoxazole, naphthoxazole, tetrazole, pyridine, quinoline, imidazoline, imidazole, benzoimidazole, naphthoimidazole, selenazoline, selenazole, benzoselenazole, naphthoselenazole, and indolenine. These heterocyclic nuclei can be substituted by, e.g., a lower alkyl group such as methyl, halogen atom, phenyl. group, hydroxyl group, 1- to 4-carbon alkoxy group, carboxyl group, alkoxycarbonyl group, alkylsulfamoyl group, alkylcarbamoyl group, acetyl group, acetoxy group, cyano group, trichloromethyl group, trifluoromethyl group, or nitro group.

Each of $L_1$ and $L_2$ independently represents an unsubstituted or substituted methine group. Examples of this substituted methine group are methine groups substituted by a lower alkyl group such as methyl or ethyl, phenyl, substituted phenyl, methoxy, and ethoxy. If both $L_1$ and $L_2$ are substituted methine groups, these substituents can combine to form a ring.

Each of $R_1$ and $R_2$ independently represents a 1- to 5-carbon alkyl group; a substituted alkyl group having a carboxy group: e.g., carboxymethyl and 3-carboxybutyl; a substituted alkyl group having a sulfo group: e.g., a substituted alkyl group having a sulfo group such as β-sulfoethyl, γ-sulfopropyl, δ-sulfobutyl, γ-sulfobutyl, 2-(3-sulfopropoxy)ethyl, 2-[2-(3-sulfopropoxy)ethoxy]ethyl, or 2-hydroxy·sulfopropyl, or an allyl group or a substituted alkyl group commonly used in an N-substituent of a cyanine dye. $X_1^-$ represents an acid anion group, e.g., an iodine ion, bromine ion, p-toluenesulfonic acid ion, or perchloric acid ion. $n_1$ represents 1 or 2. $n_1$ is 1 when the compound takes a betaine structure. $m_1$ represents 1, 2, or 3.

Representative compounds of effective spectral sensitizing dyes used in the present invention are presented below. However, the present invention is not limited to these examples.

II-1

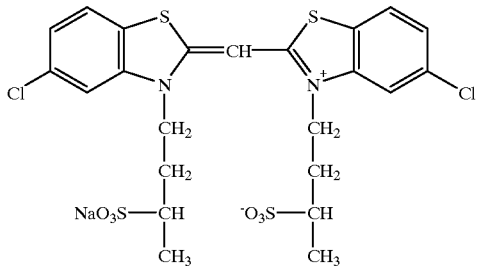

II-2

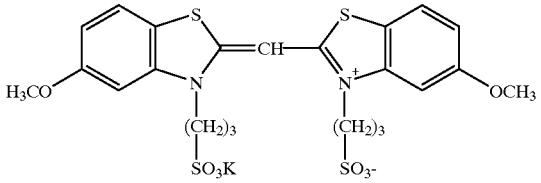

II-3

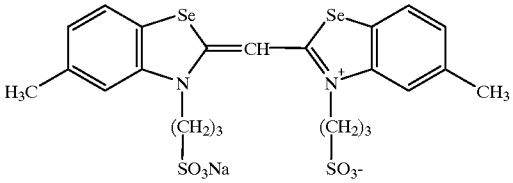

II-4

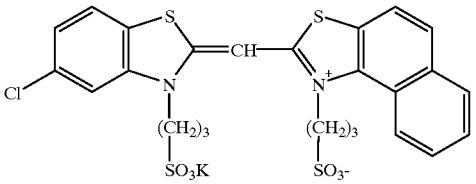

II-5

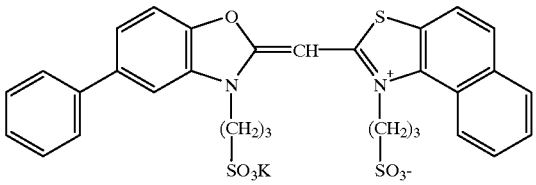

-continued

II-6

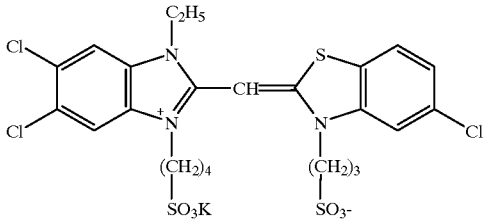

II-7

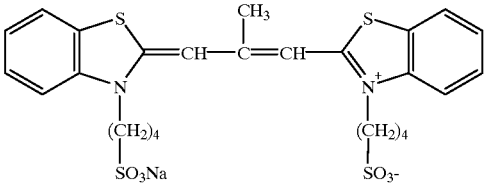

II-8

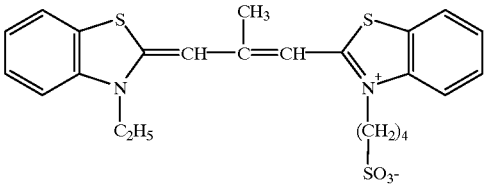

II-9

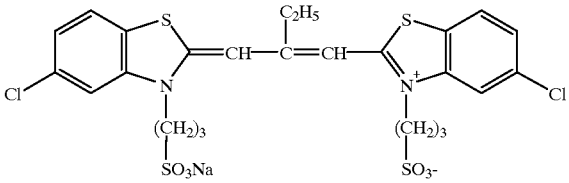

II-10

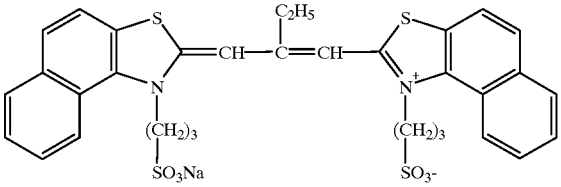

II-11

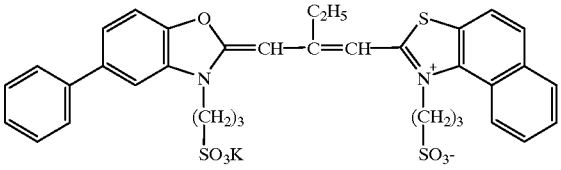

II-12

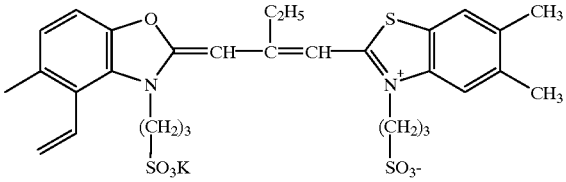

-continued
II-13
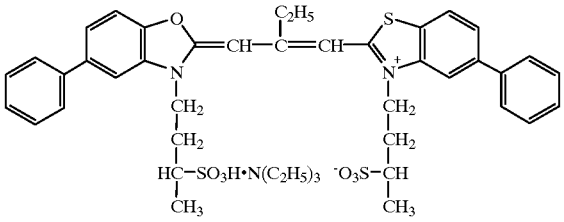
II-14
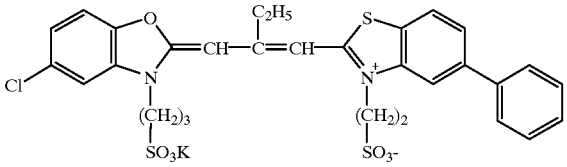
II-15
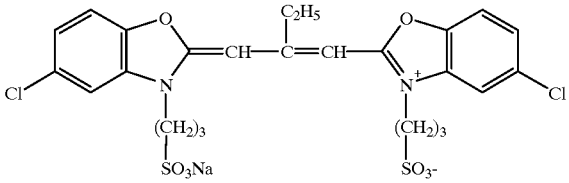
II-16
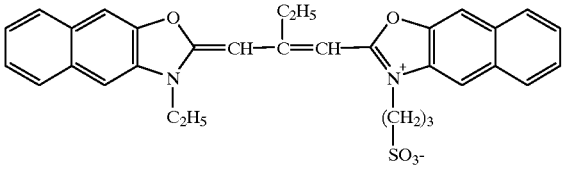
II-17
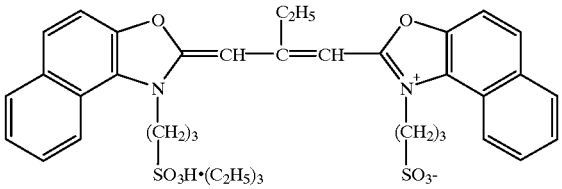
II-18
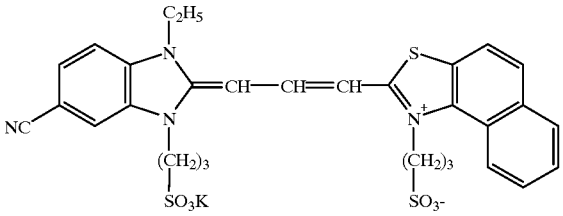
II-19
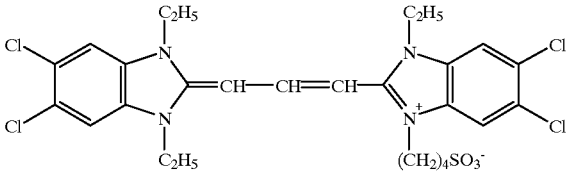
-continued
II-20
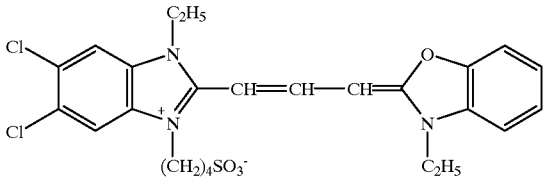
II-21
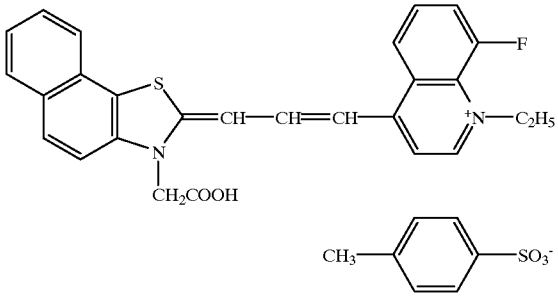
II-22
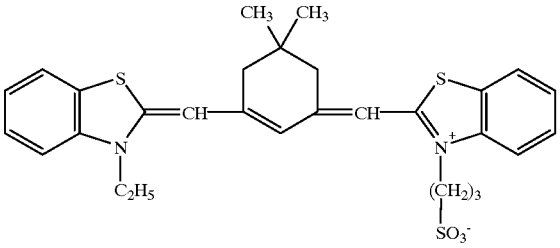
II-23
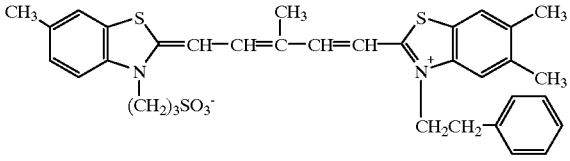
II-24
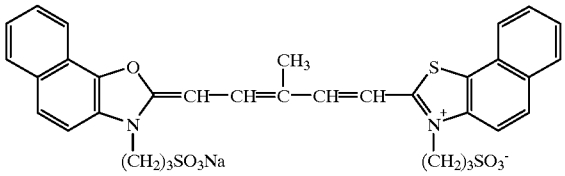
II-25
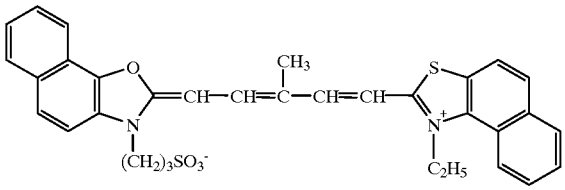

-continued

II-26

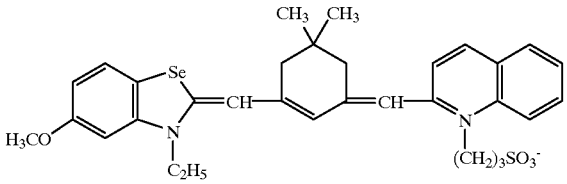

II-27

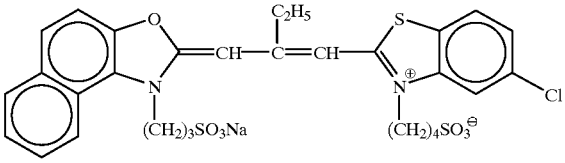

II-28

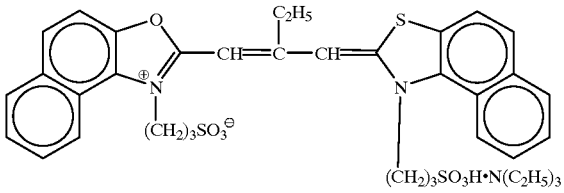

II-29

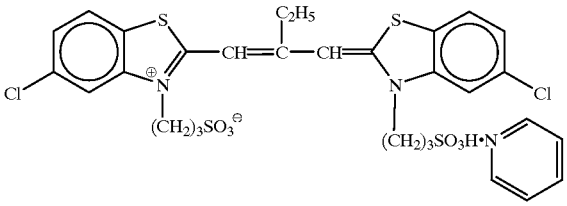

II-30

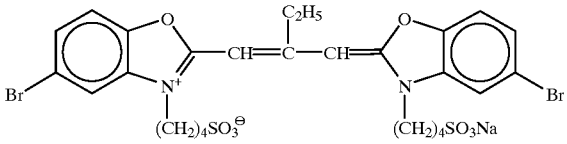

II-31

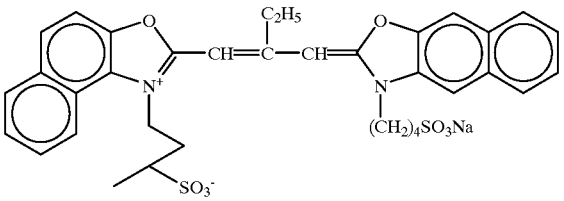

II-32

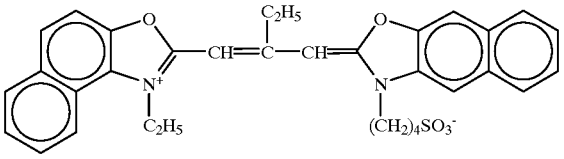

-continued

II-33

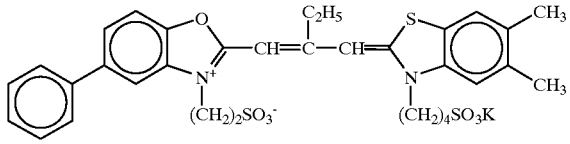

II-34

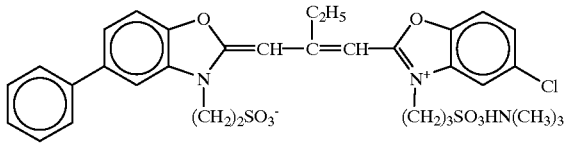

Although these sensitizing dyes can be used singly, combinations of these sensitizing dyes can also be used. Combinations of sensitizing dyes are often used for a supersensitization purpose. Representative examples of combinations are described in U.S. Pat. Nos. 2,688,545, 2,977,229, 3,397,060, 3,522,052, 3,527,641,3,617,293, 3,628,964, 3,666,480, 3,672,898, 3,679,428, 3,703,377, 3,769,301,3,814,609, 3,837,862, and 4,026,707, British Patent Nos. 1,344,281 and 1,507,803, JP-B's-43-4936 and 53-12375, and JP-A's-52-110618 and 52-109925, the disclosures of which are incorporated herein by reference.

In the present invention, two or more types of cyanine dyes selected from cyanine dyes represented by formula (II) can be added.

A cyanine dye represented by formula (II) is more preferably a monomethinecyanine dye.

In addition to sensitizing dyes, emulsions can also contain dyes having no spectral sensitizing effect or substances not essentially absorbing visible light and presenting supersensitization.

Sensitizing dyes can be added to the emulsion at any point conventionally known to be useful during emulsion preparation. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The amount of sensitizing dyes added to silver halide grains used in the present invention is preferably $5\times10^{-4}$ mol or more per mol of a silver halide. When the average silver halide grain size is 1.0 to 3.0 $\mu$m, an addition amount of about $2\times10^{-4}$ to $5\times10^{-3}$ mol is more effective.

The emulsion of the present invention is preferably prepared in the presence of a water-soluble radical scavenger.

A radical scavenger that can be used in the present invention is a compound which, when a 0.05 mmoldm$^{-3}$ ethanol solution of garvinoxyl and a 2.5 mmoldm$^{-3}$ ethanol solution of a test compound are mixed at 25° C. by a stopped flow method and changes in the absorbance with time at 430 nm are measured, substantially decolors the garvinoxyl (reduces the absorbance at 430 nm). (If dissolution is impossible at the above concentration, measurement can be performed at a lower concentration.)

The radical scavenge rate of a radical scavenger usable in the present invention is the decoloration rate constant of garvinoxyl obtained by the above method. A radical scavenger preferably has a radical scavenge rate of 0.01 $mmols^{-1}dm^3$ or more, and more preferably, 0.1 to 10 $mmols^{-1}dm^3$. A method of obtaining the radical scavenge rate by using garvinoxyl is described in Microchemical Journal 31, pp. 18 to 21 (1985), the disclosure of which is incorporated herewith by reference. A stopped flow method is described in, e.g., Spectroscopy Research Vol. 19, No. 6 (1970), p. 321, the disclosure of which is incorporated herewith by reference.

The solubility to water of the radical scavenger is represented by the distribution coefficient of an n-octanol/water system defined by:

$$\log P = \log [(Rs)_{octanol}/(Rs)_{water}]$$

where (Rs) is the radical scavenger concentration, and $(Rs)_{octanol}$ and $(Rs)_{water}$ are the concentrations in n-octanol and water, respectively.

"Being water-soluble" means that the above log P value is smaller than 1.

The distribution coefficient can be calculated by a method described in Journal of Medicinal Chemistry, Vol. 18, No. 9, pp. 865 to 868 (1975).

Examples of the radical scavenger used in the present invention are water-soluble ones of phenol-based compounds described in JP-A-7-72599 and hydroxyamine-based compounds represented by formulas (A-I) to (A-III) described in U.S. Pat. No. 5,719,007, formula (S2) described in JP-A-10-10668, formula (S1) described in JP-A-11-15102, and formula (S1) described in JP-A-10-90819, all the disclosures of which are incorporated herein by reference.

Practical examples of the water-soluble radical scavenger are presented below, but the present invention is not restricted to these examples.

RS-1

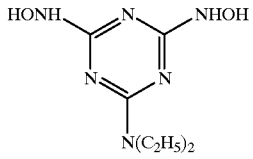

RS-2

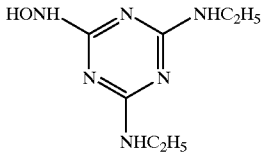

RS-3

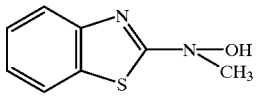

-continued

RS-4

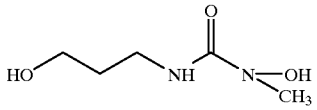

RS-5

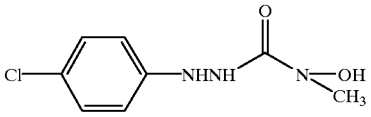

The above water-soluble radical scavenger is preferably added during emulsion preparation and can be added in any step of the process. For example, the radical scavenger can be added in a silver halide grain formation step, before the start of a desilvering step, in the desilvering step, before the start of chemical ripening, in the chemical ripening step, and before completed emulsion preparation. The radical scavenger can also be separately added a plurality of times in these steps. Preferably, the radical scavenger is added before, during, or after chemical sensitization.

A preferred addition amount of the water-soluble radical scavenger largely depends upon the addition method described above and the type of compound to be added. Generally, the addition amount is preferably $5\times10^{-6}$ to 0.5 mol, and more preferably, $1\times10^{-5}$ to 0.005 mol per mol of a photosensitive silver halide. An addition amount larger than the above value is unpreferable because bad influence such as an increase in fog occurs.

Two or more types of radical scavengers can be used together.

The radical scavenger can be added by dissolving it in water or a water-soluble solvent, such as methanol, or ethanol, or in a solvent mixture of these, or can be added by emulsified dispersion. When the radical scavenger is dissolved in water, the pH can be raised or lowered if the solubility rises when the pH is raised or lowered, and the resultant solution can be added. A surfactant can also be present at the same time.

In the present invention, the tabular grains preferably have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 35, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the principal planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

Dislocation lines can be introduced in, for example, the vicinity of the periphery of tabular grains. In this instance, the dislocation is nearly perpendicular to the periphery, and each dislocation line extends from a position corresponding to x% of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes.

In the present invention, dislocation lines are most preferably introduced by adding a sparingly soluble silver halide emulsion to the silver bromide, silver chlorobromide, silver bromochloroiodide, or silver iodobromide tabular emulsion described above. A sparingly soluble silver halide emulsion is more sparingly soluble than the tabular grain emulsion in terms of a halogen composition, and is preferably a silver iodide fine grain emulsion.

In the present invention, dislocation lines are preferably introduced by abruptly adding a silver iodide fine grain emulsion to the tabular grain emulsion described above. This step substantially includes two steps: a step of abruptly adding a silver iodide fine grain emulsion to the tabular grain emulsion, and a step of introducing dislocation lines by growing silver bromide or silver iodobromide. These two steps are sometimes performed completely separately and can also be performed at the same time. Preferably, the steps are performed separately. The first step of rapidly adding a silver iodide fine grain emulsion to the tabular grain emulsion will be described below.

"Rapidly adding a silver iodide fine grain emulsion" is to add a silver iodide fine grain emulsion within preferably ten minutes, and more preferably, seven minutes. This condition can vary in accordance with the temperature, pBr, and pH of the system to which the emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate be not substantially added. The temperature of the system during the addition is preferably 40° C. to 90° C., and particularly preferably, 50° C. to 80° C. The pBr of a silver iodide fine grain emulsion during the addition is not particularly limited.

The silver iodide fine grain emulsion substantially need only be silver iodide and can contain silver bromide and/or silver chloride as long as a mixed crystal can be formed. The emulsion is preferably 100% silver iodide. The crystal structure of silver iodide can be a β phase, a γ phase, or, as described in U.S. Pat. No. 4,672,026, an a phase or an a phase similar structure. In the present invention, the crystal structure is not particularly restricted but is preferably a mixture of β and γ phases, and more preferably, a β phase. The silver iodide fine grain emulsion can be either an emulsion formed immediately before addition described in U.S. Pat. No. 5,004,679 or an emulsion subjected to a regular washing step. In the present invention, an emulsion subjected to a regular washing step is preferably used. The silver iodide fine grain emulsion can be readily formed by a method described in, e.g., aforementioned U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.08 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine grain emulsion are obtained by placing silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected area of the observed grain. The grain size distribution also is obtained by using this equivalent-circle diameter of the projected area. In the present invention, the most effective silver iodide fine grains have a grain size of 0.07 to 0.02 μm and a grain size distribution variation coefficient of 18% or less.

After the grain formation described above, the silver iodide fine grain emulsion is preferably subjected to regular washing described in, e.g., U.S. Pat. No. 2,614,929, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is preferably used. It is sometimes convenient to use a mixture of gelatins having different molecular weights. The gelatin amount is preferably 10 to 100 g, and more preferably, 20 to 80 g per kg of an emulsion. The silver amount is preferably 10 to 100 g, and more preferably, 20 to 80 g, as the amount of silver atoms, per kg of an emulsion. As the gelatin amount and/or the silver amount, it is preferable to choose values suited to the rapid addition of the silver iodide fine grain emulsion.

The addition amount of a silver iodide fine grain emulsion is preferably 1 to 10 mol %, and most preferably, 2 to 7 mol %, as a silver amount, with respect to a tabular grain emulsion. By choosing this addition amount, dislocation lines are preferably introduced, and the effect of the present invention becomes conspicuous. A silver iodide fine grain emulsion is usually dissolved before being added. During the addition it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

After a silver iodide fine grain emulsion is rapidly added to a tabular grain emulsion, silver bromide or silver iodobromide is grown to introduce dislocation lines. Although the growth of silver bromide or silver iodobromide can be started before or at the same time the addition of a silver iodide fine grain emulsion, the growth of silver bromide or silver iodobromide is preferably started after the addition of a silver iodide fine grain emulsion. The time from the addition of a silver iodide fine grain emulsion to the start of the growth of silver bromide or silver iodobromide is preferably 10 min to 1 sec, more preferably, 5 min to 3 sec, and most preferably, within 1 min. This time interval is preferably as short as possible and is favorably before the start of the growth of silver bromide or silver iodobromide.

Silver bromide is preferably grown after the addition of a silver iodide fine grain emulsion. When silver iodobromide is used, the silver iodide content is 3 mol % or less with respect to the corresponding layer. Assume that the total silver amount of a completed tabular grain emulsion is 100, the silver amount of a layer grown after the addition of this silver iodide fine grain emulsion is preferably 5 to 50, and most preferably, 10 to 30. The temperature, pH, and pBr during the formation of this layer are not particularly restricted. However, the temperature is usually 40° C. to 90° C., and more preferably, 50° C. to 80° C., and the pH is usually 2 to 9, and more preferably, 3 to 7. In the present invention, the pBr at the end of the formation of the layer is preferably higher than that in the initial stages of the layer formation. Preferably, the pBr in the initial stages of the layer formation is 2.9 or less, and the pBr at the end of the layer formation is 1.7 or more. More preferably, the pBr in the initial stages of the layer formation is 2.5 or less, and the pBr at the end of the layer formation is 1.9 or more. Most preferably, the pBr in the initial stages of the layer formation is 1 to 2.3, and pBr at the end of the layer formation is 2.1 to 4.5. Dislocation lines are preferably introduced in the present invention by the above method.

In the formation of silver halide grains of the present invention, at least one of chalcogen sensiti-zation including sulfur sensitization and selenium sensitization, and noble metal sensitization including gold sensitization and palladium sensitization can be performed at any point during the process of preparing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization nucleus can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361,3,297,446, 3,772,031,3, 857,711,3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the modifier of chemical sensitization aid are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyanide compound or a selenocyanide compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the present invention, a thiocyanate is preferably added before the addition of the aforementioned spectral sensitizing dyes and chemical sensitizers. A thiocyanate is preferably added after grain formation, and more preferably, after a desilvering step. Since a thiocyanate is preferably added during chemical sensitization, the addition of a thiocyanate is performed twice or more. Examples of a thiocyanate are potassium thiocyanate, sodium thiocyanate, and ammonium thiocyanate.

A thiocyanate is usually dissolved in an aqueous solution or a water-soluble solvent before being added. The addition amount is preferably $1\times10^{-5}$ to $1\times10^{-2}$ mol, and more preferably, $5\times10^{-5}$ to $5\times10^{-3}$ mol per mol of a silver halide.

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol with partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention to form a newly prepared protective colloid dispersion for a desalting purpose. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg during washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, method using an organic solvent, method using a water-soluble polymer, and method using a gelatin derivative.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

It is preferable to use an oxidizer for silver, in addition to a halogen oxoacid salt, during the process of preparing emulsions of the present invention. However, positive hole capturing silver nuclei obtained by reduction sensitization of the grain surface must remain to such an extent that the sensitivity/fog ratio is optimum in terms of photographic properties. A particularly effective compound is the one that converts those fine silver nuclei into silver ions, which are produced as a by-product in the processes of formation and chemical sensitization of silver halide grains and chemical sensitization, which do not contribute to an increase in the sensitivity, and which cause an increase in fog. The silver ions produced can form a silver salt hard to dissolve in water, such as a silver halide, silver sulfide, or silver selenide, or can form a silver salt easy to dissolve in water, such as silver nitrate.

Preferable oxidizers are an inorganic oxidizer of thiosulfonate and an organic oxidizer of quinones.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The above various additives can be used in the lightsensitive material according to the present technology, to which other various additives can also be added in conformity with the object.

The additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |

-continued

| | Types of additives | RD17643 | RD18716 | RD308119 |
|---|---|---|---|---|
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

With respect to the photographic lightsensitive material of the present invention and the emulsion suitable for use in the photographic lightsensitive material and also with respect to layer arrangement and related techniques, silver halide emulsions, dye forming couplers, DIR couplers and other functional couplers, various additives and development processing which can be used in the photographic lightsensitive material, reference can be made to EP 0565096A1 (published on October 13, 1993) and patents cited therein, all the disclosures of which are incorporated herein by reference. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical ripening of emulsion: page 63 lines 6 to 9,
13. Emulsion mixing: page 63 lines 10 to 13,
14. Fogged emulsions: page 63 lines 14 to 31,
15. Nonlightsensitive emulsions: page 63 lines 32 to 43,
16. Silver coating amounts: page 63 lines 49 to 50.
17. The additives are described in detail in Research Disclosure Item 17643 (December 1978), Item 18716 (November 1979) and Item 307105 (November 1989), the disclosures of which are incorporated herein by reference.

A summary of the locations where they are described will be listed in the following table.

| | Types of additives | RD17643 | RD18716 | RD307105 |
|---|---|---|---|---|
| 1 | Chemical sensitizers | page 23 | page 648 right column | page 866 |
| 2 | Sensitivity increasing agents | | page 648 right column | |
| 3 | Spectral sensitizers, super-sensitizers | pages 23–24 | page 648, right column to page 649, right column | pages 866 to 868 |
| 4 | Brighteners | page 24 | page 647, right column | page 866 |
| 5 | Antifoggants, stabilizers | pages 24–25 | page 649, right column | pages 868 to 870 |
| 6 | Light absorbents, filter dyes, ultraviolet absorbents | pages 25–26 | page 649, right column to page 650, left column | page 873 |
| 7 | Stain preventing agents | page 25, right column | page 650, left to right columns | page 872 |
| 8 | Dye image stabilizers | page 25 | page 650, left column | page 872 |
| 9 | Film hardeners | page 26 | page 651, left column | pages 874 to 875 |
| 10 | Binders | page 26 | page 651, left column | pages 873 to 874 |
| 11 | Plasticizers, lubricants | page 27 | page 650, right column | page 876 |
| 12 | Coating aids, surfactants | pages 26–27 | page 650, right column | pages 875 to 876 |
| 13 | Antistatic agents | page 27 | page 650, right column | pages 876 to 877 |
| 14 | Matting agents | | | pages 878 to 879. |

18. Formaldehyde scavengers: page 64 lines 54 to 57,
19. Mercapto-type antifoggants: page 65 lines 1 to 2,
20. Fogging agent, etc. releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler summary: page 65 lines 39 to 44,
28. Bleaching accelerator-releasing couplers: page 65 lines 45 to 48,
29. Development accelerator-releasing couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swell speed: page 66 line 40 to page 67 line 1,
35. Back layers: page 67 lines 3 to 8,
36. Development processing summary: page 67 lines 9 to 11,
37. Developing solution and developing agents: page 67 lines 12 to 30,
38. Developing solution additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. washing, rinse and stabilization: page 69 line 41 to page 70 line 18,
45. Processing solution replenishment and recycling: page 70 lines 19 to 23,
46. Developing agent built-in sensitive material: page 70 lines 24 to 33,
47. Development processing temperature: page 70 lines 34 to 38, and
48. Application to film with lens: page 70 lines 39 to 41

Moreover, preferred use can be made of a bleaching solution containing 2-pyridinecarboxylic acid or 2,6-pyridinedicarboxylic acid, a ferric salt such as ferric nitrate and a persulfate as described in EP No. 602,600, the disclosure of which is incorporated herein by reference. When this bleaching solution is used, it is preferred that the steps of stop and water washing be conducted between the steps of color development and bleaching. An organic acid such as acetic acid, succinic acid or maleic acid is preferably used in the stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter referred to as "L").

Examples of the present invention will be described below. However, the present invention is not restricted to these examples.

EXAMPLE 1

This example shows that an increase in fog occurring when the photographic light-sensitive material containing a photosensitive silver halide emulsion is aged in an oxygen atmosphere can be significantly eliminated by the means disclosed in the present invention.

Gelatin-1 to gelatin-4 used as dispersion media in the preparation of emulsions described below have the following attributes.

Gelatin-1: Conventional alkali-processed ossein gelatin made from cattle bones. No $-NH_2$ groups in the gelatin were chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified $—NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified $—NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No $—NH_2$ groups in the gelatin were chemically modified.

All of gelatin-1 to gelatin-4 described above were deionized and so adjusted that the pH of an aqueous 5% solution at 35° C. was 6.0.

Preparing Method of Emulsion A-1

42.2 L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 described above were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of gelatin-2 described above and 79.2 g of KBr were added, and 15,947 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90. After washing with water, gelatin-1 described above was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of gelatin-2 and 1.7 g of KBr were vigorously stirred at 75° C. After 9.9 g of the seed emulsion described above were added, 0.3 g of modified silicone oil (L7602 manufactured by Nippon Uniker K.K.) was added. Sulfuric acid was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 μm was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1 was added, and the pH and the pAg were adjusted to 5.8 and 8.7, respectively, at 40° C. (process (1)). The temperature was raised to 60° C., and $4.2\times10^{-4}$ mol of a sensitizing dye Exs-1 was added per mol of a silver halide (process (2)). After that, the emulsion was optimally chemically sensitized by adding potassium thiocyanate, chloroauric acid, sodium thiosulfate, and N,N-dimethylselenourea. $1\times10^{-3}$ mol of a compound RS-1 was added per mol of a silver halide (process (3)). At the end of this chemical sensitization, compounds EXA-2 and EXA-3 were added. "optimally chemically sensitized" means that the addition amount of each compound was selected from the range of $10^{-1}$ to $10^{-8}$ mol per mol of a silver halide.

The obtained emulsion had an average equivalent-sphere diameter of 1.05 μm and an average aspect ratio of 10. Also, 60% of the total projected area of all grains were accounted for by tabular silver halide grains having an aspect ratio of 9.0 to 12 and an average AgI content of 15 mol % and containing (111) faces as parallel main planes.

Compound RS-1

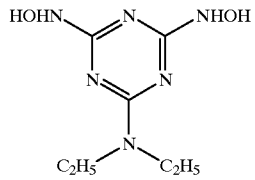

Exs-1

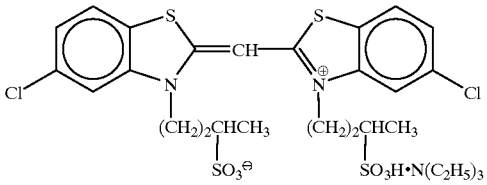

ExA-2

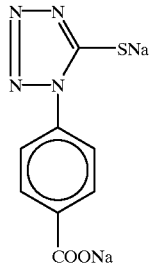

ExA-3

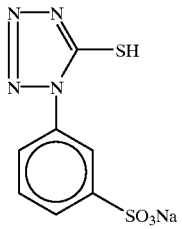

(Preparation of emulsion A-2)

An emulsion A-2 was prepared following the same procedures as for the emulsion A-1, except that $1\times10^{-5}$ mol of sodium chlorite was added per mol of a silver halide before the compounds ExA-2 and ExA-3 were added at the end of the chemical sensitization (process (3)).

Preparation of Emulsions A-3 to A-10 and A-13

Emulsions A-3 to A-10 were prepared following the same procedures as for the emulsion A-2, except that halogen oxoacid salts and oxidizers were added as shown in Table 1 in place of sodium chlorite.

TABLE 1

| Sample No. | Emulsion No. | Halogen oxoacid salt (mol/mol of silver halide)/Addition timing | Sensitivity | Increment of fog due to oxygen | Remarks |
|---|---|---|---|---|---|
| 101 | A-1 | None | 100 | 0.12 | Comparison |
| 102 | A-2 | $NaClO_2$ ($1.0 \times 10^{-5}$)/At the completion of chemical sensitization | 100 | 0.01 | Invention |
| 103 | A-3 | $NaBrO_3$ ($1.0 \times 10^{-5}$)/At the completion of chemical sensitization | 100 | 0.06 | Invention |
| 104 | A-4 | $NaIO_3$ ($1.0 \times 10^{-5}$)/At the completion of chemical sensitization | 98 | 0.06 | Invention |
| 105 | A-5 | $H_2O_2$ ($2.0 \times 10^{-5}$)/At the completion of chemical sensitization | 100 | 0.11 | Comparison |
| 106 | A-6 | NaClO ($2.0 \times 10^{-5}$)/At the completion of chemical sensitization | 82 | 0.13 | Comparison |
| 107 | A-7 | $K_2S_2O_8$ ($1.0 \times 10^{-5}$)/At the completion of chemical sensitization | 100 | 0.12 | Comparison |
| 108 | A-8 | $I_2$ ($2.0 \times 10^{-5}$)/At the completion of chemical sensitization | 97 | 0.12 | Comparison |
| 109 | A-9 | $C_8H_{17}SO_2SNa$ ($1.0 \times 10^{-5}$)/At the completion of chemical sensitization | 100 | 0.12 | Comparison |
| 110 | A-10 | Sodium benzenethiosulfonate ($1.0 \times 10^{-5}$)/At the completion of chemical sensitization | 100 | 0.12 | Comparison |
| 111 | A-11 | $NaClO_2$ ($1.0 \times 10^{-5}$)/At the completion of grain formation | 100 | 0.02 | Invention |
| 112 | A-12 | $NaClO_2$ ($1.0 \times 10^{-5}$)/At the completion of spectral sensitization | 100 | 0.02 | Invention |
| 113 | A-13 | $NaClO_2$ ($1.0 \times 10^{-5}$)/At the time of coating | 100 | 0.08 | Comparison |
| 114 | A-14 | $KIO_4$ ($1.0 \times 10^{-5}$)/At the completion of chemical sensitization | 99 | 0.12 | Comparison |

Preparation of Emulsion A-11

An emulsion A-11 was prepared following the same procedures as for the emulsion A-1, except that $1\times10^{-5}$ mol of sodium chlorite was added per mol of a silver halide at the end of the grain formation (process (1)).

Preparation of Emulsion A-12

An emulsion A-12 was prepared following the same procedures as for the emulsion A-1, except that $1\times10^{-5}$ mol of sodium chlorite was added per mol of a silver halide at the end of the spectral sensitization (process (2)).

The emulsions A-1 and A-2 were observed at a liquid nitrogen temperature by using a 400-kV transmission electron microscope. Consequently, 10 or more dislocation lines were present in the fringe portions of tabular grains of each emulsion.

Note that the emulsions A-1 to A-13 described above were reduction-sensitized by the addition of thiourea dioxide in the abovementioned emulsion preparation steps.

A cellulose triacetate film support having an undercoat layer was coated with each of the emulsions A-1 to A-13 under the coating conditions as shown in Table 2 below. The coated samples were named samples 101 to 112 and 114.

TABLE 2

| Emulsion coating conditions | |
|---|---|
| (1) | Emulsion layer |
| | Emulsions . . . Various emulsions |
| | (Silver $1.63 \times 10^{-2}$ mol/m$^2$) |
| | Coupler ($2.26 \times 10^{-3}$ mol/m$^2$) |

TABLE 2-continued

| Emulsion coating conditions |
|---|
| 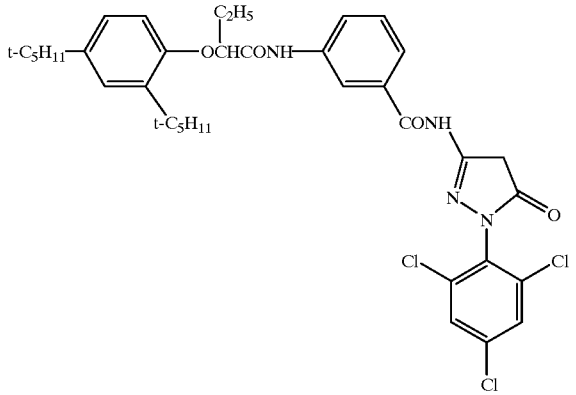 |
| Tricresylphosphate (1.32 g/m$^2$)<br>Gelatin (3.24 g/m$^2$) |
| (2) Protective layer |
| Sodium 2,4-dichloro-6-hydroxyl-S-triazine (0.08 g/m$^2$)<br>Gelatine (1.80 g/m$^2$) |

Preparation of Sample 113

Sample 113 was prepared following the same procedures as for sample 101 coated with the emulsion A-1, except that $1\times10^{-5}$ mol of sodium chlorite was added to the coating solution per mol of a silver halide.

These samples were subjected to film hardening for 14 hr at 40° C. and a relative humidity of 70%. After that, the samples were exposed for 1/100 sec through a gelatin filter SC-50 (a long-wavelength light transmitting filter having a cutoff wavelength of 500 nm) manufactured by Fuji Photo Film Co., Ltd. and a continuous wedge. Each resultant sample was developed following the same procedures as in development described in page 16 of JP-A-11-153840, except that the processing time of color development was changed to 2 min 45 sec. The densities of the processed samples were measured through a green filter to evaluate their photographic properties. The sensitivity is represented by a relative value of the reciprocal of an exposure amount necessary to reach a density of fog density plus 0.2 (the sensitivity of the emulsion A-1 is assumed to be 100).

Test for Evaluating Fog Increase Caused by Oxygen

An increase in fog with time caused by oxygen in the coated samples described above was evaluated by the following method.

Samples 101 to 114 were left to stand at 40° C. for three days by using a stainless-steel pressure-resistant vessel (autoclave) under two conditions: 5 atm of nitrogen and a relative humidity of 80% (aging (1)) and 5 atm of oxygen and a relative humidity of 80% (aging (2)). After that, exposure and development described above were performed, and the density in a fogged portion was measured through a green filter in the same manner as above. The rise of the fog density in aging (2) under oxygen from the fog density in aging (1) under nitrogen was calculated as a fog increase caused by oxygen.

The results of evaluation performed by the above method are also shown in Table 1 above.

It is evident from the results shown in Table 2 that the increase in fog by oxygen can be significantly reduced by preparing emulsion grains by adding halogen oxoacid salts defined in the present invention. The effect of the present invention cannot be achieved by known hydrogen peroxide and sodium hypochlorite although they are also oxidizers. Of halogen oxoacid salts defined in the present invention, the fog reducing effect of chlorite is particularly notable. Similar effects can be obtained at the end of grain formation and at the end of spectral sensitization, as well as at the end of chemical sensitization. The effects when halogen oxoacid salts are added during coating, not in the preparation of emulsions, are unsatisfactory.

Although details of the mechanism of halogen oxoacid salts of the present invention are unknown, halogen oxoacid salts presumably react with silver nuclei causing the aging fog and remove them. No effects can be obtained by strong oxidizers because they react with organic compounds around emulsion grains. The balance of the rates of reactions of halogen oxoacid salts defined in the present invention with silver nuclei and organic compounds is probably within an appropriate range.

EXAMPLE 2

The effectiveness of halogen oxoacid salts of the present invention with respect to tabular grains having a high aspect ratio will be described below.

Preparing Method of Emulsion B-1

1,211 mL of an aqueous solution containing 46 g of gelatin-2 of Example 1 and 1.7 g of KBr were vigorously stirred at 75° C. After 3.0 g of the seed emulsion used in the emulsion A-1 of Example 1 were added, 0.3 g of modified silicone oil (L7602 manufactured by Nippon Uniker K.K.) was added. Sulfuric acid was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15 (growth process 2). After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 μm was simultaneously added at an accelerated flow rate so that the silver iodide content was 14 mol %. At the same time, the pAg of the bulk emulsion solution in the reaction vessel was held at 8.60 (growth process 3). 121.3 mL of an aqueous solution containing 45.6 g of $AgNO_3$ and an aqueous KBr solution were added over 22 min by the double jet method (growth process 4). During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80 (growth process 5). After washing with water, gelatin-1 described above was added, and the pH and the pAg were adjusted to 5.8 and 8.7, respectively, at 40° C. $1\times10-1^3$ mol of the compound RS-1 was added per mol of a silver halide, the temperature was raised to 60° C. After the sensitizing dye Exs-1 was added, the emulsion was optimally chemically sensitized by adding potassium thiocyanate, chloroauric acid, sodium thiosulfate, and N,N-dimethylselenourea. At the end of this chemical sensitization, the compound ExA-3 was added. "Optimally chemically sensitized" means that the addition amounts of the sensitizing dye and each compound were selected from the range of $10^{-1}$ to $10^{-8}$ mol per mol of a silver halide.

The thus obtained emulsion consisted of tabular silver halide grains whose parallel main planes were (111) faces, and had an equivalent-sphere diameter of 1.05 μm and an average aspect ratio of 10. Also, 60% of the total projected area of the grains had an aspect ratio of 9.5 to 11.5 and an average AgI content of 15.1 mol %.

Preparing Method of Emulsion B-2

An emulsion B-2 was prepared following the same procedures as for the emulsion B-1, except that the pAg was changed from 8.60 to 7.70 in growth process 3. Note that the amount of Ex-1 was so adjusted that the emulsion was optimally chemically sensitized. The obtained emulsion had an average aspect ratio of 3.0, and 60% of the total projected area of the grains had an aspect ratio of 2.5 to 4.5.

Preparing Method of Emulsion B-3

An emulsion B-3 was prepared following the same procedures as for the emulsion B-1, except that the pAg was changed from 8.60 to 8.00 in growth process 3. Note that the amount of Exs-1 was so adjusted that the emulsion was optimally chemically sensitized. The obtained emulsion had an equivalent-sphere diameter of 1.05 μm and an average aspect ratio of 6.0. Also, 60% of the total projected area of the grains had an aspect ratio of 5.5 to 7.5.

Preparing Method of Emulsion B-4

An emulsion B-4 was prepared following the same procedures as for the emulsion B-1, except that (growth process 2) and (growth process 3) were changed as follows. Note that the amounts of RS-1 and Exs-1 used in chemical sensitization were changed such that the emulsion was optimally chemically sensitized.

Growth Process 2

1,211 mL of an aqueous solution containing 46 g of gelatin-2 described above and 1.7 g of KBr were vigorously stirred at 75° C. After 3.0 g of the aforementioned seed emulsion were added, 0.3 g of modified silicone oil (L7602 manufactured by Nippon Uniker K.K.) was added. Sulfuric acid was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.80.

Growth Process 3

After 2 mg of sodium benzenethiosulfonate and 5 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 μm was simultaneously added at an accelerated flow rate so that the silver iodide content was 14.4 mol %. At the same time, the pAg of the bulk emulsion solution in the reaction vessel was held at 8.80.

The obtained emulsion consisted of tabular silver halide grains whose parallel main planes were (111) faces, and had an equivalent-sphere diameter of 0.50 μm and an average aspect ratio of 10. Also, 60% of the total projected area of the grains had an aspect ratio of 9.5 to 11.5 and an average AgI content of 9.2 mol %.

Preparing Method of Emulsion C-1

An emulsion C-1 was prepared following the same procedures as for the emulsion B-1, except that $1\times10^{-5}$ mol of sodium chlorite was added per mol of a silver halide before the compound ExA-3 was added at the end of chemical sensitization.

Preparing Method of Emulsion C-3

An emulsion C-3 was prepared following the same procedures as for the emulsion B-3, except that $1\times10^{-5}$ mol of sodium chlorite was added per mol of a silver halide before the compound EXA-3 was added at the end of chemical sensitization.

Preparing Method of Emulsion C-4

An emulsion C-4 was prepared following the same procedures as for the emulsion B-4, except that $1\times10^{-5}$ mol of sodium chlorite was added per mol of a silver halide before the compound EXA-3 was added at the end of chemical sensitization.

Following the same procedures as in Example 1, coating of the emulsions B-1 to B-4, C-1, and C-3 to C-4 was performed. The coated samples were named samples 201 to 207.

Tests for evaluating the sensitivity and the fog increase caused by oxygen were also performed in the same manner as in Example 1.

Assume the sensitivity of sample 202 of the emulsion B-2 is 100.

The obtained results are shown in Table 3 below.

TABLE 3

| Sample No. | Emulsion No. | Aspect ration (Average) | Average equivalent sphere diameter (μm) | Halogen oxoacid salts (mol/mol of silver halide) | Sensitivity | Increment of fog due to oxygen | Remarks |
|---|---|---|---|---|---|---|---|
| 201 | B-1 | 10 | 1.05 | None | 112 | 0.11 | Comparison |
| 202 | B-2 | 3 | 1.05 | None | 100 | 0.05 | Comparison |
| 203 | B-3 | 6 | 1.05 | None | 105 | 0.09 | Comparison |
| 204 | B-4 | 10 | 0.50 | None | 53 | 0.07 | Comparison |
| 205 | C-1 | 10 | 1.05 | $NaClO_2(1.0 \times 10^{-5})$ | 112 | 0.01 | Invention |
| 206 | C-3 | 6 | 1.05 | $NaClO_2(1.0 \times 10^{-5})$ | 105 | 0.00 | Invention |
| 207 | C-4 | 10 | 0.50 | $NaClO_2(1.0 \times 10^{-5})$ | 53 | 0.01 | Invention |

The following is obvious from the results shown in Table 3. The sensitivity can be raised by raising the aspect ratio of tabular silver halide grains and increasing the addition amount of a sensitizing dye per mol of a silver halide. In this case, however, the fog increase caused by oxygen extremely worsens. When a halogen oxoacid salt was added to an emulsion having a high aspect ratio, it is possible to improve the sensitivity and suppress the fog increase caused by oxygen at the same time.

If the average equivalent-sphere diameter of grains is 0.5 μm or less, the sensitivity is unsatisfactory although the addition of a halogen oxoacid salt achieves its reducing effect.

EXAMPLE 3

The advantages of a silver halide color photographic light-sensitive material using emulsions of the present invention will be described below.

Silver halide emulsions D-a, D-b, E-a, E-b, F-a, F-b, G-a, G-b, and H to R were prepared by the following prepring methods.

Preparing Method of Emulsion D-a

The emulsion D-a was prepared following the same procedures as for the emulsion B-1 of Example 2, except that $2.75\times10^{-4}$ mol of the sensitizing dye Exs-1 and $2.25\times10^{-4}$ mol of a sensitizing dye Exs-2 were added per mol of a silver halide.

Preparing Method of Emulsion D-b

The emulsion D-b was prepared following the same procedures as for the emulsion D-a, except that $1\times10^{-5}$ mol of sodium chlorite was added per mol of a silver halide before the compounds ExA-2 and ExA-3 were added at the end of the chemical sensitization.

Preparing method of emulsion E-a 1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion A-1 was simultaneously added at an accelerated flow rate so that the silver iodide content was 15.8 mol %. At the same time, the pAg of the bulk emulsion solution in the reaction vessel was held at 7.85. 96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was lowered to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the completion of the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized in substantially the same manner as for the emulsion D-a. Also, the compounds RS-1, ExA-2, and ExA-3 were added in substantially the same manner as for the emulsion D-a.

Preparing Method of Emulsion E-b

The emulsion E-b was prepared following the same procedures as for the emulsion E-a, except that $7\times10^{-6}$ mol of sodium chlorite was added per mol of a silver halide before the compounds ExA-2 and ExA-3 were added at the end of the chemical sensitization.

Preparing Method of Emulsion F-a 1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion A-1 was simultaneously added at an accelerated flow rate so that the silver iodide content was 2.3 mol %. At the same time, the pAg of the bulk emulsion solution in the reaction vessel was held at 8.50. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water and chemically sensitized in substantially the same manner as for the emulsion D-a. Also, the compounds RS-1, ExA-2, and ExA-3 were added in substantially the same manner as for the emulsion D-a.

Preparing Method of Emulsion F-b

The emulsion F-b was prepared following the same procedures as for the emulsion F-a, except that $7\times10^{-6}$ mol of sodium chlorite was added per mol of a silver halide before the compounds ExA-2 and ExA-3 were added at the end of the chemical sensitization.

Preparing Method of Emulsion G-a

In the preparation of the emulsion F-a, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. The emulsion G-a was prepared following substantially the same procedures as for the emulsion F-a except the foregoing.

Preparing Method of Emulsion G-b

The emulsion G-b was prepared following the same procedures as for the emulsion G-a, except that $7\times10^{-6}$ mol of sodium chlorite was added per mol of a silver halide before the compounds ExA-2 and ExA-3 were added at the end of the chemical sensitization.

Preparation of Emulsion H 1,300 mL of an aqueous solution containing 1.0 g of KBr and 1.1 g of gelatin-4 of Example 1 were stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by the triple jet method. After that, 6.5 g of KBr were added, and the temperature was raised to 75° C. After a ripening step was performed for 12 min, 300 mL of an aqueous solution G-2 (containing 12.7 g of gelatin-3 of Example 1 in 100 mL) were added.

Subsequently, 2.1 g of Disodium 4,5-dihydroxybenzene-1, 3-disulfonate were Added.

157 mL of an aqueous solution Ag-2 (containing 22.1 g of $AgNO_3$ in 100 ML) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30. Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30. Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate, and the addition of the aqueous solution X-4 was so performed that the pAg of the bulk emulsion solution in the reaction vessel was held at 7.52 (addition 1).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. Subsequently, 73.9 g of an AgI fine grain emulsion (containing 13.0 g of AgI fine grains having an average grain size of 0.047 $\mu$m in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4.

After that, desalting was performed by normal flocculation. Water, NaOH, and gelatin-i described above were added under stirring, and the pH and the pAg were adjusted to 6.4 and 8.6, respectively, at 56° C.

Subsequently, $5.50\times10^{-4}$, $1.30\times10^{-4}$, and $4.65\times10^{-5}$ mol of the sensitizing dyes Exs-3, Exs-4, and Exs-5 were added per mol of a silver halide. Before chemical sensitization was performed, $2\times10^{-3}$ mol of a compound ExA-1 was added per mol of a silver halide. The emulsion was optimally chemically sensitized by sequentially adding potassium thiocyanate, chloroauric acid, sodium thiosulfate, and N,N-dimethylselenourea. After that, $2\times10^{-3}$ mol of the compound RS-1 was added per mol of a silver halide (addition 2). The chemical sensitization was completed by adding water-soluble mercapto compounds MER-1 and MER-2 presented below at a ratio of 4:1 such that the total amount was $3.6\times10^{-4}$ mol per mol of a silver halide.

MER-1

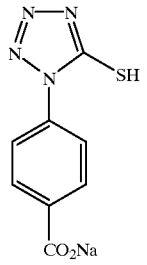

-continued

MER-2

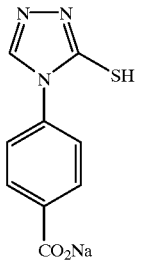

Preparing Method of Emulsion I 1,200 mL of an aqueous solution containing 0.75 g of gelatin-4 of Example 1 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and KBr was added to adjust the pAg of the bulk emulsion solution in the reaction vessel to 9.50. After that, the aforementioned AgI fine grain emulsion was added in an amount of 5.73 g in terms of a KI weight. Immediately after the addition, 609 mL of an aqueous solution containing 66.4 g were added over 10 min. For the first 6 min of the addition, the pAg of the bulk emulsion solution in the reaction vessel was held at 9.50 by an aqueous KBr solution. After washing with water, gelatin-1 of Example 1 was added, and the pH and the pAg were adjusted to 6.5 and 8.2, respectively. The resultant emulsion was chemically sensitized in substantially the same manner as for the emulsion H. The compound RS-1 was also added in an amount of $2\times10^{-3}$ mol per mol of a silver halide. The use amounts of the sensitizing dyes ExS-3, ExS-4, and ExS-5 were $1.08\times10^{-3}$, $2.56\times10^{-4}$, and $9.16\times10^{-5}$ mol, respectively, per mol of a silver halide.

Preparing Method of Emulsion J 1,200 mL of an aqueous solution containing 0.70 g of gelatin-4 of Example 1, 0.9 g of KBr, 0.175 g of KI, and 0.2 g of the modified silicone oil used in the preparation of the emulsion A-1 were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-4 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion D was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized in substantially the same manner as for the emulsion H. The compound RS-1 was also added in an amount of $2\times10^{-3}$ mol per mol of a silver halide. The use amounts of the sensitizing dyes ExS-3, ExS-4, and ExS-5 were $1.25\times10^{-3}$, $2.85\times10^{-4}$, and $3.29\times10^{-5}$ mol, respectively, per mol of a silver halide.

Preparing Method of Emulsion K

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate of potash were added. After 14.4 g of KBr were added, the AgI fine grain emulsion used in the preparation of the emulsion A-1 was added in an amount of 6.3 g in terms of a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized in substantially the same manner as for the emulsion H. The compound RS-1 was also added in an amount of $2\times10^{-3}$ mol per mol of a silver halide. The use amounts of the sensitizing dyes ExS-3, ExS-4, and ExS-5 were $5.79\times10^{-4}$, $1.32\times10^{-4}$, and $1.52\times10^{-5}$ mol, respectively, per mol of a silver halide.

Preparing Method of Emulsion L

An emulsion L was prepared following substantially the same procedures as for the emulsion K except that the nucleation temperature was changed to 35° C. The compound RS-1 was also added in an amount of $2\times10^{-3}$ mol per mol of a silver halide. The use amounts of the sensitizing dyes ExS-3, ExS-4, and ExS-5 were $9.66\times10^{-4}$, $2.20\times10^{-4}$, and $2.54\times10^{-5}$ mol, respectively, per mol of a silver halide.

Preparing Method of Emulsion M 1,200 mL of an aqueous solution containing 0.75 g of gelatin-4 of Example 1 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 g in terms of a KI weight. Immediately after the addition, 609 mL of an aqueous solution containing 66.4 g were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively. Subsequently, $2\times10^{-3}$ mol of the compound RS-1 was added per mol of a silver halide, and the temperature was raised to 56° C. The sensitizing dye ExS-3 and a sensitizing dye ExS-6 were added. After that, potassium thiocyanate, chloroauric acid, sodium thiosulfate, and N,N-dimethylselenourea were added to ripen and optimally chemically sensitize the emulsion. At the end of the chemical sensitization, the compounds ExA-2 and EXA-3 were added. The use amounts of the sensitizing dyes ExS-3 and ExS-6 were $3.69\times10^{-4}$ and $8.19\times10^{-4}$ mol, respectively, per mol of a silver halide.

Preparing Method of Emulsion N 1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion A-1 was simultaneously added at an accelerated flow rate such that the silver iodide content was 6.5 mol %. At the same time, the pAg of the bulk emulsion solution in the reaction vessel was held at 9.05. 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively. $1\times10^{-3}$ mol of the compound RS-1 was added per mol of a silver halide, and the temperature was raised to 58° C. After sensitizing dyes ExS-7, ExS-8, and ExS-9 were added, the emulsion was optimally chemically sensitized by adding $K_2IrCl_6$, potassium thiocyanate, chloroauric acid, sodium thiosulfate, and N,N-dimethylselenourea. At the end of the chemical sensitization, the compounds ExA-2 and ExA-3 were added.

Preparing Method of Emulsion 0

In the preparation of the emulsion N, the amounts of $AgNO_3$, KBr, and KI added during nucleation were changed to 1.96, 1.67, and 0.172 g, respectively. Also, the chemical sensitization temperature was changed from 58° C. to 61° C. An emulsion 0 was prepared following substantially the same procedures as for the emulsion N, except the foregoing. Also, the compounds RS-1, ExA-2, and ExA-3 were added in substantially the same manner as for the emulsion N.

Preparing Method of Emulsion P 1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion N. Also, the compounds RS-1, ExA-2, and ExA-3 were added in substantially the same manner as for the emulsion N.

Preparing Methods of Emulsions Q and R

Emulsions Q and R were prepared following substantially the same procedures as for the emulsions K and L, respectively, except that chemical sensitization was performed in substantially the same manner as for the emulsion 0. Also, the compounds RS-1, ExA-2, and ExA-3 were added in substantially the same manner as for the emulsion N.

The chemical structures of the sensitizing dyes used in the emulsions D-a, D-b, E-a, E-b, F-a, F-b, G-a, G-b, and H to R are collectively presented below.

Exs-1

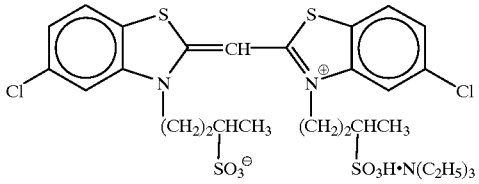

Exs-2

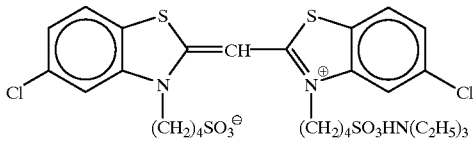

Exs-3

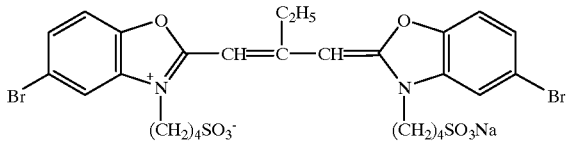

-continued

Exs-4

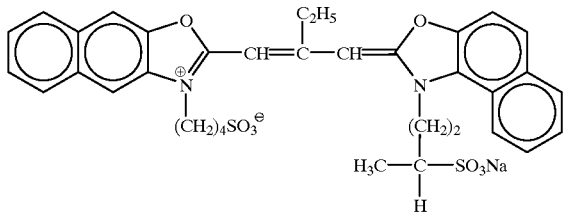

Exs-5

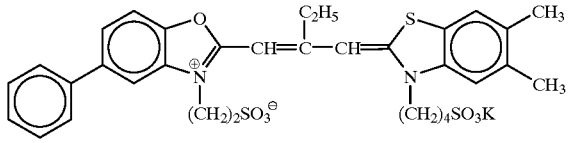

Exs-6

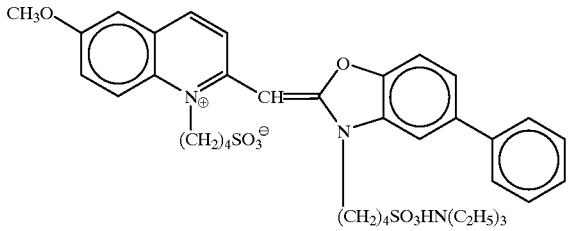

Exs-7

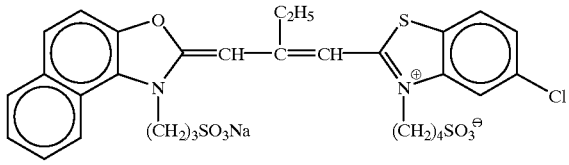

Exs-8

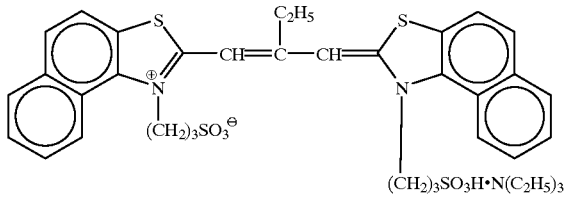

Exs-9

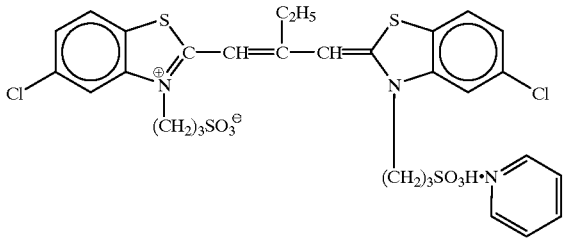

The characteristic values of the silver halide emulsions described above are summarized in Table 4.

Note that dislocation lines as described in JP-A-3-237450 were observed in the silver halide grains of the emulsions D-a, D-b, E-a, E-b, F-a, F-b, G-a, G-b, and H to R by using a high-voltage electron microscope.

TABLE 4

| Emulsion No. | Equivalent circle diameter (μm) | Thickness (μm) | Aspect ratio | Ration of (111) grains* | AgI content (mol %) | AgCl content (mol %) |
|---|---|---|---|---|---|---|
| D-a | 1.98 | 0.198 | 10 | 92 | 15 | 0 |
| D-b | 1.98 | 0.198 | 10 | 92 | 15 | 0 |
| E-a | 1.30 | 0.108 | 12 | 93 | 11 | 0 |
| E-b | 1.30 | 0.108 | 12 | 93 | 11 | 0 |
| F-a | 1.00 | 0.083 | 12 | 93 | 4 | 1 |
| F-b | 1.00 | 0.083 | 12 | 93 | 4 | 1 |
| G-a | 0.75 | 0.075 | 10 | 91 | 4 | 2 |
| G-b | 0.75 | 0.075 | 10 | 91 | 4 | 2 |
| H | 2.01 | 0.161 | 12.5 | 99 | 3.9 | 0 |
| I | 1.54 | 0.077 | 20 | 99 | 5.3 | 0 |
| J | 1.08 | 0.072 | 15 | 97 | 6 | 0 |
| K | 0.44 | 0.220 | 2 | 90 | 3 | 2 |
| L | 0.33 | 0.165 | 2 | 88 | 3 | 2 |
| M | 2.25 | 0.107 | 21 | 99 | 7.2 | 0 |
| N | 2.38 | 0.138 | 17 | 98 | 5 | 1 |
| O | 1.83 | 0.122 | 15 | 98 | 5 | 1 |
| P | 0.84 | 0.120 | 7 | 99 | 3 | 0 |
| Q | 0.44 | 0.220 | 2 | 88 | 2 | 2 |
| R | 0.33 | 0.165 | 2 | 88 | 1 | 2 |
| S | 0.07 | 0.070 | 1 | — | 1 | 0 |
| T | 0.07 | 0.070 | 1 | — | 0.9 | 0 |

*Ratio of grains having (111) main planes to the total projected area

1) Support

The support employed in this Example was prepared by the following method.

100 parts by weight of polyethylene 2,6-naphthalate polymer and 2 parts by weight of Tinuvin P.326 (produced by Ciba-Geigy) as an ultraviolet absorber were dried, melted at 300° C., extruded through a T die, longitudinally oriented at 140° C. to a 3.3-fold length, laterally oriented at 130° C. to a 3.3-fold width and thermally set at 250° C. for 6 sec. Thus, a PEN (polyethylene naphthalate) film having a thickness of 90 μm was obtained. Appropriate amounts of blue dye, magenta dye and yellow dye (I-1, I-4, I-6, I-24, I-26, I-27 and II-5 described in JIII Journal of Technical Disclosure No. 94-6023) were mixed in this PEN film. Further, this PEN film was wound round a stainless steel core with a diameter of 20 cm, and a 110° C./48 hr heat history was imparted thereto. Thus, a support with a low tendency to curl was obtained.

2) Application of Subbing Layer by Coating

Both sides of the above support were treated by corona discharge, UV irradiation and glow discharge. Thereafter, a subbing liquid consisting of 0.1 g/m$^2$ of gelatin, 0.01 g/m$^2$ of sodium α-sulfo-di-2-ethylhexyl succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of polyamide/epichlorohydrin polycondensate was applied onto each of the sides (10 mL/m$^2$ by the use of a bar coater) so that a subbing layer was provided on a side exposed to high temperature at the time of orientation. Drying was conducted at 115° C. for 6 mm (all of the rollers and conveyor of drying zone were heated at 115° C.)

3) Application of back layer by coating:

After the subbing, an antistatic layer, a magnetic recording layer and a slide layer of the following respective compositions as back layers were applied by coating to one side of the support.

3-1) Application of Antistatic Layer by Coating

Coating was made with 0.2 g/m$^2$ of a dispersion of fine grain powder with a resistivity of 5 Ω·cm (secondary aggregate grain diameter: approximately 0.08 μm) composed of a tin oxide/antimony oxide composite having an average particle size of 0.005 μm, 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10) and 0.22 g/m$^2$ of resorcinol.

3–2) Application of Magnetic Recording Layer by Coating

A magnetic recording layer having a thickness of 1.2 μm was obtained by applying, by means of a bar coater, 0.06 g/m$^2$ of cobalt/γ-iron oxide (specific surface area: 43 m$^2$/g, major axis: 0.14 μm, minor axis: 0.03 μm, saturation magnetization: 89 emu/g, $Fe^{2+}/Fe^{3+}$=6/94, surface treated with aluminum oxide/silicon oxide in an amount of 2% by weight based on iron oxide) coated with 3-polyoxyethylene-propyloxytrimethoxysilane (polymerization degree: 15; 15% by weight), 1.2 g/m$^2$ of diacetylcellulose (iron oxide dispersed by the use of an open kneader and a sand mill) and 0.3 g/m$^2$ of $C_2H_5C(CH_2OCONH{-}C_6H_3(CH_3)NCO)_3$ as a hardener together with acetone, methyl ethyl ketone and cyclohexanone as a solvent. As a matting agent, silica particles (0.3 μm) and abrasive aluminum oxide (0.15 μm) coated with 3-polyoxyethylene-propyloxytrimethoxysilane (polymerization degree 15; 15% by weight) were each added in an amount of 10 mg/m$^2$. Drying was conducted at 115° C. for 6 min (all of the rollers and conveyor of drying zone were heated at 115° C.). With respect to the obtained magnetic recording layer, the $D^B$ color density increment with X-lite (blue filter), saturation magnetization moment, coercive force and rectangular ratio were approximately 0.1, 4.2 emu/g, 7.3×10$^4$ A/m and 65%, respectively.

3-3) Preparation of Slide Layer

Coating was made with a mixture of diacetylcellulose (25 mg/m$^2$) and $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). This mixture was prepared by melting in xylene/propylene monomethyl ether (1/1) at 105° C. and pouring and dispersing in propylene monomethyl ether (10-fold amount) at ordinary temperature and formed into a dispersion (average particle size: 0.01 μm) in acetone before addition. As a matting agent, silica particles (0.3 μm) and abrasive aluminum oxide (0.15 μm) coated with 3-polyoxyethylene-propyloxytrimethoxysilane (polymerization degree 15; 15% by weight) were each added in an amount of 15 mg/m$^2$. Drying was conducted at 115° C. for 6 min (all of the rollers and conveyor of drying zone were heated at 115° C.). With respect to the obtained slide layer, the kinematic friction coefficient (stainless steel hard ball with a diameter of 5 mm, load: 100 g, speed: 6 cm/min), static friction coefficient (clip method) and kinematic friction coefficient between emulsion face and slide layer as described later were 0.06, 0.07 and 0.12, respectively, ensuring excellent performance.

4) Application of Lightsensitive Layer by Coating (Sample 301)

The side opposite to the thus obtained back layers was coated with a plurality of layers of the following respective compositions, thereby obtaining a color negative lightsensitive material of Sample 301.

Composition of Lightsensitive Layers

Main materials used in each layer are classified as follows, however, the function of each compound is not limited to one indicated:

ExC: cyan coupler, UV: ultraviolet absorber,
ExM: magenta coupler, HBS: high b.p. org. solvent,
ExY: yellow coupler, H: gelatin hardener.

(For each specific compound, in the following description, numeral is assigned after the character, and the formula is shown later).

The numeric value given beside the description of each component is for the coating amount expressed in the unit of $g/m^2$. With respect to the silver halide, the coating amount is in terms of silver quantity.

| | | |
|---|---|---|
| 1st layer (1st antihalation layer) | | |
| Black colloidal silver | silver | 0.155 |
| Silver iodobromide emulsion T | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.077 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.014 |
| Solid disperse dye ExF-3 | | 0.020 |
| 3rd layer (Interlayer) | | |
| Silver iodobromide emulsion S | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodobromide emulsion R | silver | 0.065 |
| Silver iodobromide emulsion Q | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion P | silver | 0.21 |
| Silver iodobromide emulsion O | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion N | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| ExG-1 | | 0.002 |
| Cpd-2 | | 0.046 |
| Cpd-4 | | 0.077 |
| HBS-1 | | 0.25 |
| HBS-2 | | 0.12 |
| F-19 | | $1.0 \times 10^{-5}$ |
| F-20 | | $1.0 \times 10^{-5}$ |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |

-continued

| | | |
|---|---|---|
| Gelatin | | 0.84 |
| 8th layer (layer for donating interimage effect to red-sensitive layer) | | |
| Silver iodobromide emulsion M | silver | 0.560 |
| Cpd-3 | | 0.020 |
| Cpd-4 | | 0.030 |
| ExM-2 | | 0.096 |
| ExM-3 | | 0.028 |
| ExY-1 | | 0.031 |
| ExG-1 | | 0.003 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion L | silver | 0.39 |
| Silver iodobromide emulsion K | silver | 0.28 |
| Silver iodobromide emulsion J | silver | 0.35 |
| ExM-2 | | 0.36 |
| ExM-3 | | 0.045 |
| ExG-1 | | 0.005 |
| Cpd-3 | | 0.010 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion I | silver | 0.45 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| Cpd-3 | | 0.006 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver iodobromide emulsion I | silver | 0.25 |
| Silver iodobromide emulsion H | silver | 0.76 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-3 | | 0.004 |
| Cpd-4 | | 0.007 |
| HBS-1 | | 0.18 |
| Polyethylacrylate latex | | 0.099 |
| F-19 | | $1.0 \times 10^{-5}$ |
| F-20 | | $1.0 \times 10^{-5}$ |
| Gelatin | | 1.11 |
| 12th layer (Yellow filter layer) | | |
| Yellow colloidal silver | silver | 0.010 |
| Cpd-1 | | 0.16 |
| Oil-soluble dye ExF-5 | | 0.010 |
| Solid disperse dye ExF-6 | | 0.153 |
| HBS-1 | | 0.082 |
| Gelatin | | 1.057 |
| 13th layer (Low-speed blue-sensitive emulsion layer) | | |
| Silver iodobromide emulsion E-a | silver | 0.20 |
| Silver iodobromide emulsion F-a | silver | 0.07 |
| Silver iodobromide emulsion G-a | silver | 0.18 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |

-continued

| | | |
|---|---|---|
| ExG-1 | | 0.001 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion D-a | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| Silver iodobromide emulsion S | silver | 0.30 |
| UV-1 | | 0.21 |
| UV-2 | | 0.13 |
| UV-3 | | 0.20 |
| UV-4 | | 0.025 |
| F-18 | | 0.009 |
| HBS-1 | | 0.12 |
| HBS-4 | | $5.0 \times 10^{-2}$ |
| Gelatin | | 2.3 |
| 16th layer (2nd protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, P-4 to P-6, F-1 to F-9, F-11 to F-20, B-4 to B-6, iron salt, lead salt, gold salt, platinum salt, palladium salt, iridium salt, ruthenium salt, and rhodium salt. Additionally, a sample was made by adding $8.5\times10^{-3}$ and $7.9\times10^{-3}$ g, per mol of a silver halide, of calcium in the form of an aqueous calcium nitrate solution to the coating solutions of the 8th and 11th layers, respectively. Preparation of dispersions of organic solid disperse Dyes.

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, a solid dispersion ExF-4 was obtained. The average grain size of fine dye grains was 0.45 μm. ExF-2 was dispersed by a microprecipitation dispersion method described in Example 1 of EP549,489A. The average grain size was found to be 0.06 μm.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled through the mill for 8 hr at a peripheral speed of about 10 m/sec and a discharge amount of 0.5 L/min. The average grain size was 0.52 μm.

Compounds used in the formation of each layer were as follows.

ExC-1

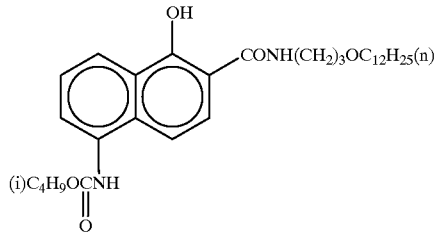

ExC-2

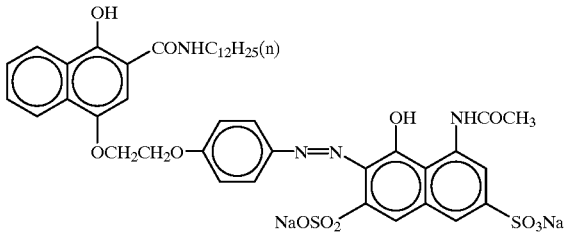

ExC-3

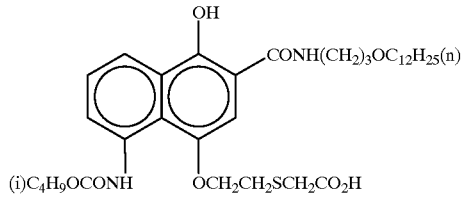

ExC-4

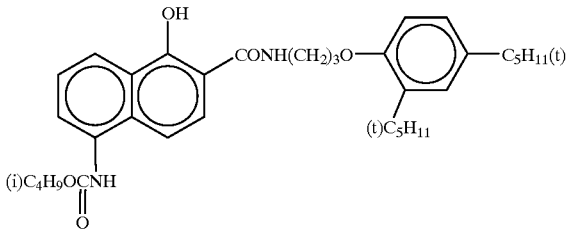

-continued
ExC-5
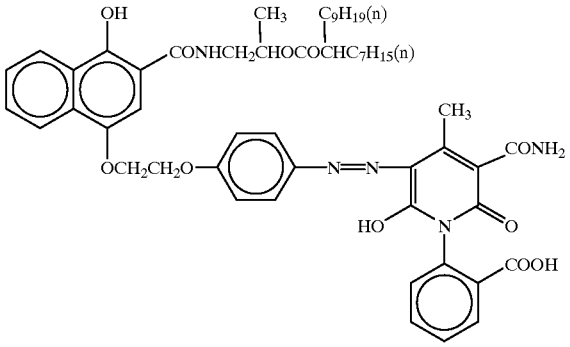
ExC-6
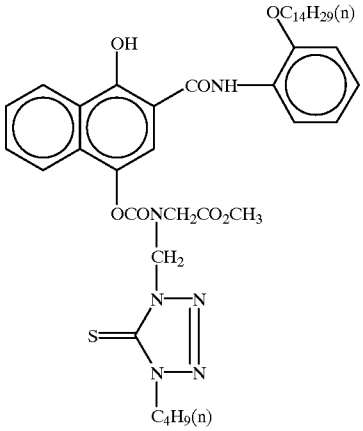
ExC-7
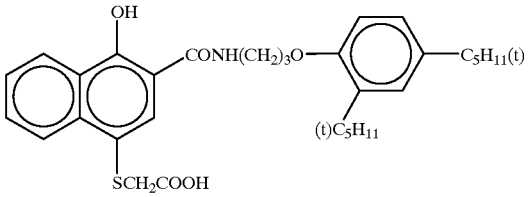
ExC-8
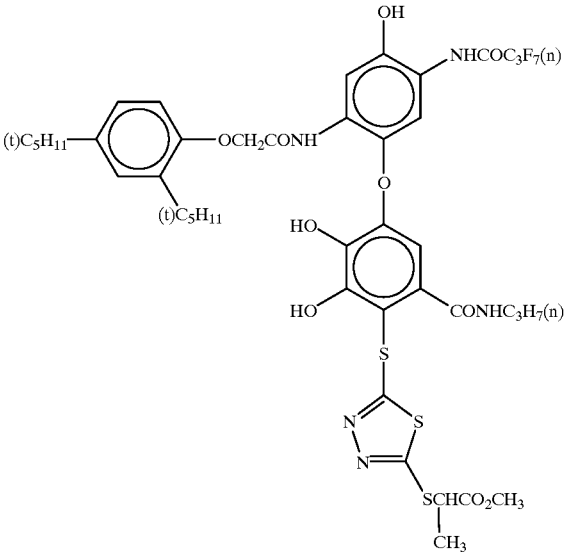
ExM-1
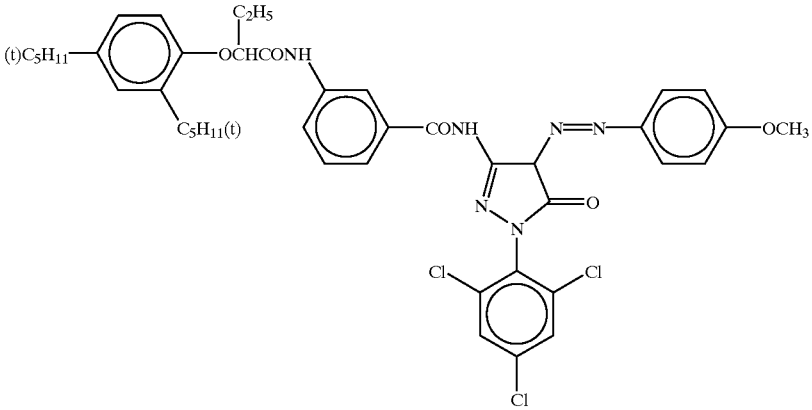

-continued
ExM-2
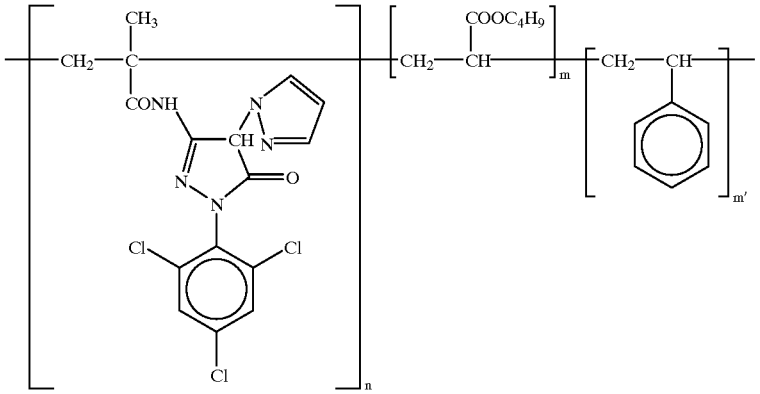
n = 50
m = 25
m′ = 25
mol. wt.
about 20,000
ExM-3
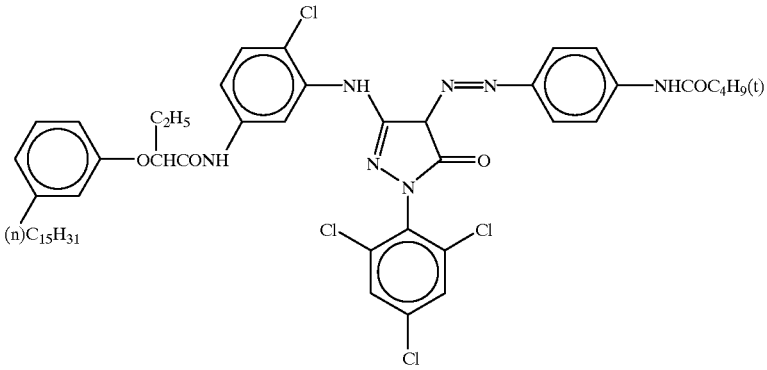
ExM-4
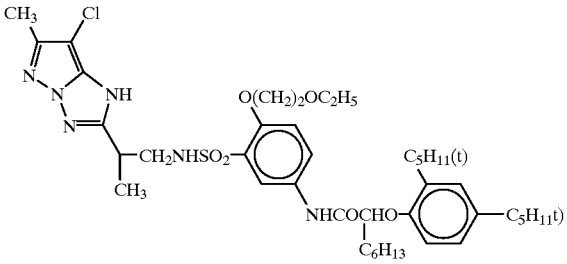
ExM-5
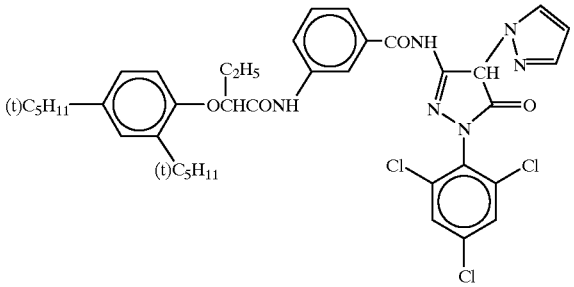
ExY-1
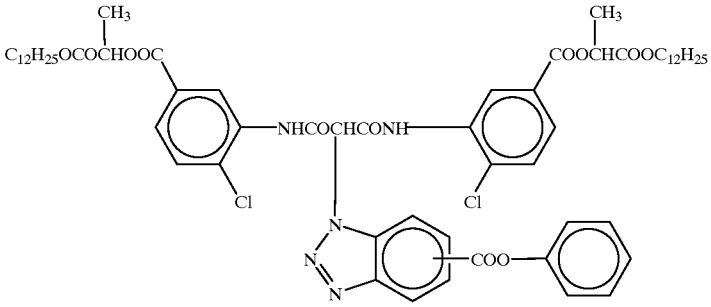

-continued
ExY-2
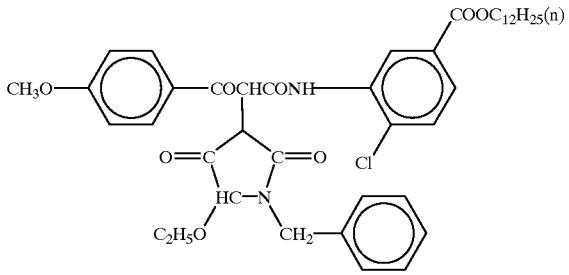
ExY-3
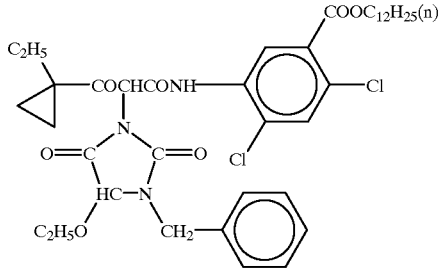
ExY-4
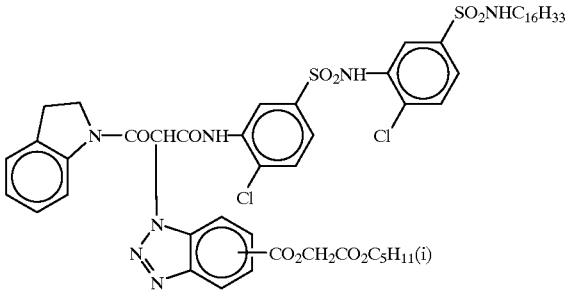
ExY-5
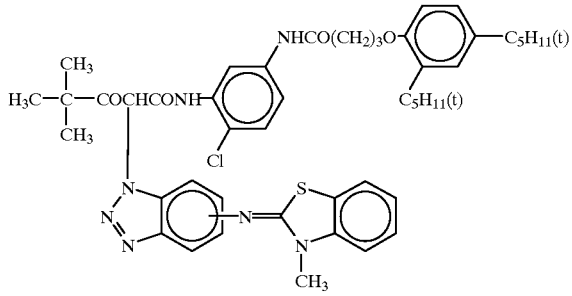
ExG-1
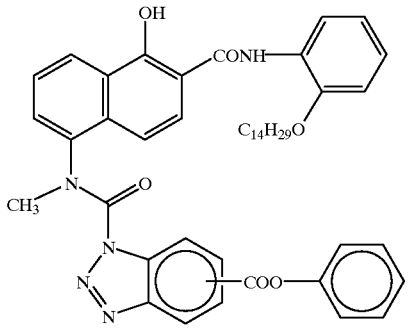
ExY-6
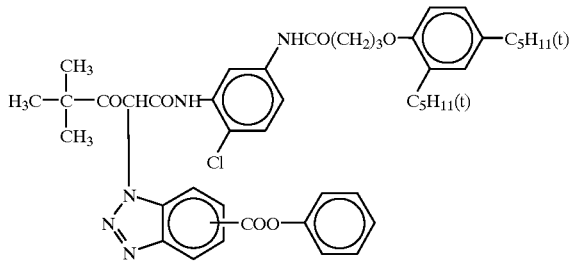
ExF-1
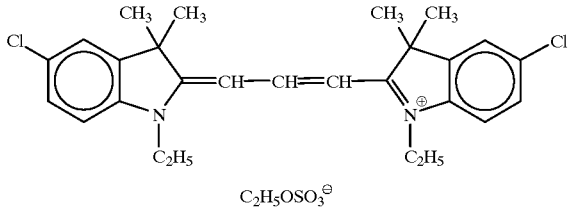
ExF-2
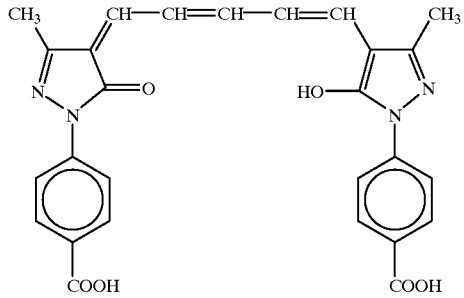
ExF-3
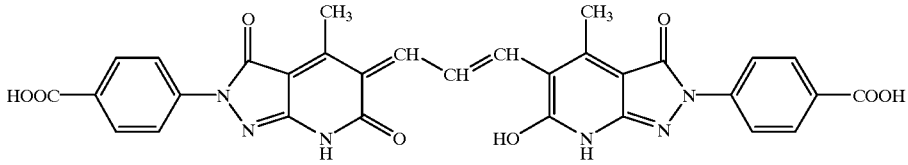

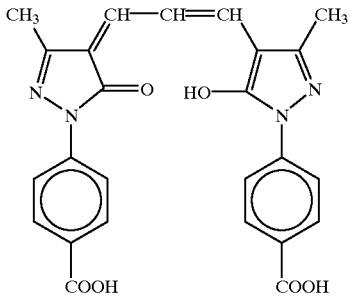
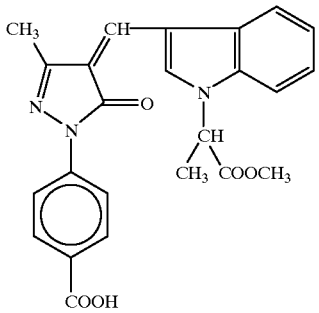
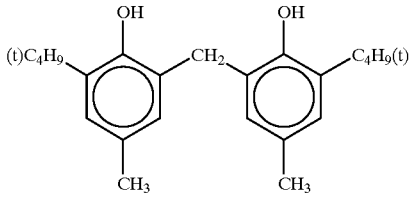
$n\text{-}C_{14}H_{29}OCOCH_2CH_2CONOH$
$CH_3$
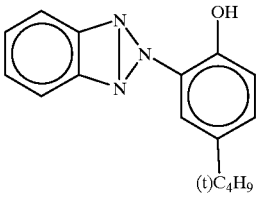
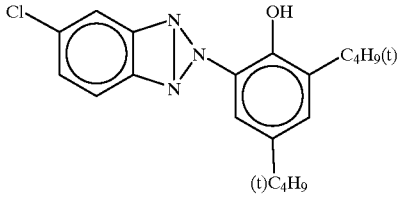
Di-n-butyl phthalate
-continued
ExF-4
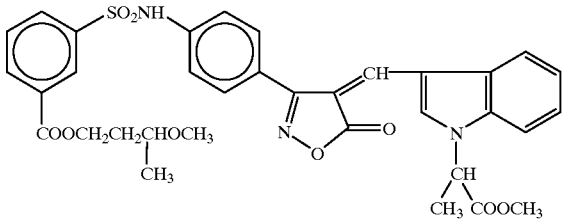
ExF-5
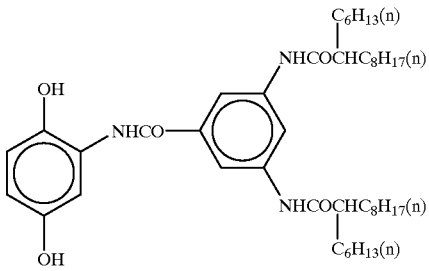
ExF-6
Cpd-1
Cpd-2
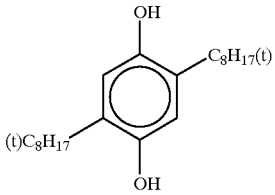
Cpd-3
Cpd-4
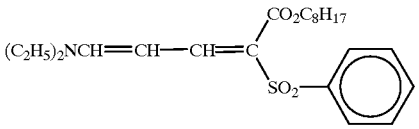
UV-1
UV-2
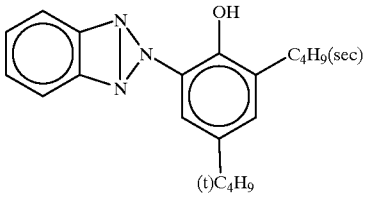
UV-3
UV-4
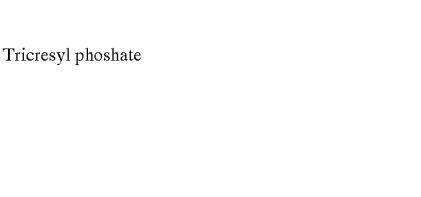
HBS-1
Tricresyl phoshate
HBS-2
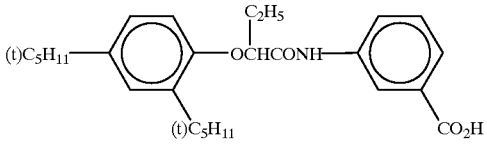
HBS-3

-continued
Tri(2-ethylhexyl) phosphate
HBS-4
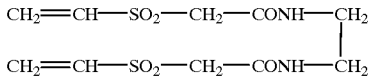
H-1
S-1
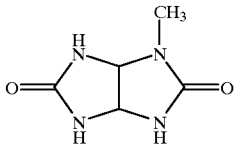
B-1
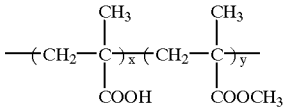
x/y = 10/90 (Weight ratio)
Average mol. wt.:
about 35,000
B-2
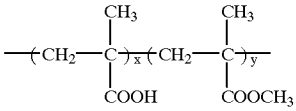
x/y = 40/60 (Weight ratio)
Average mol. wt.:
about 20,000
B-3
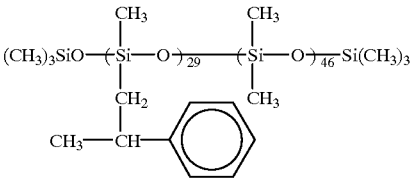
(Molar ratio)
Average mol. wt.:
about 8,000
B-4
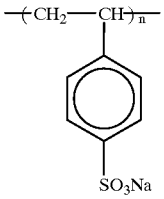
Average mol. wt.:
about 750,000
B-5
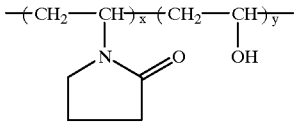
x/y = 70/30 (Weight ratio)
Average mol. wt.:
about 17,000
B-6
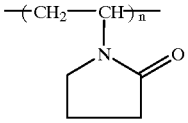
Average mol. wt.:
about 10,000
W-1
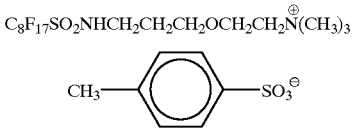
W-2
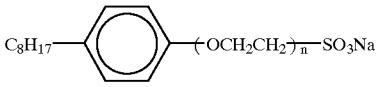
n = 2–4
W-3
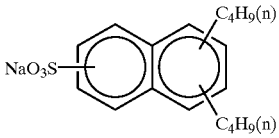
W-4
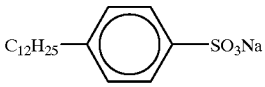
W-5
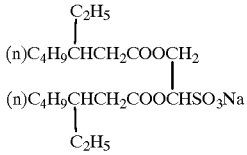
F-1
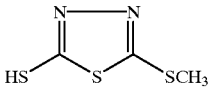
F-2
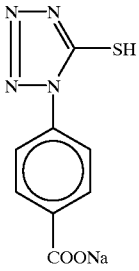

-continued
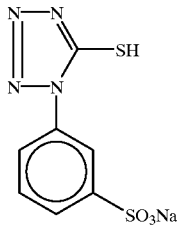
F-3
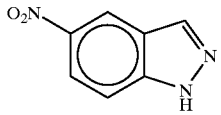
F-4
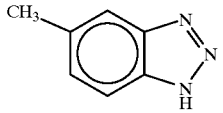
F-5
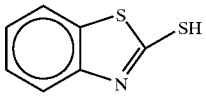
F-6
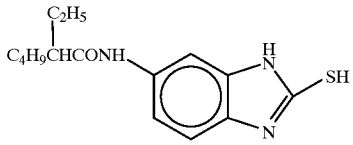
F-7
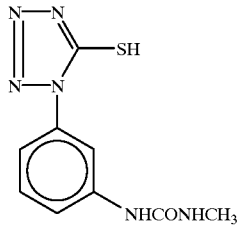
F-8
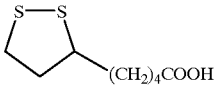
F-9
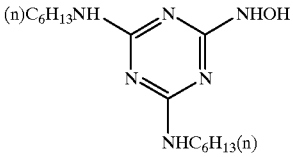
F-10
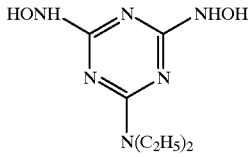
F-11
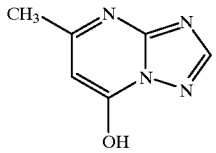
F-12
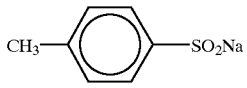
F-13
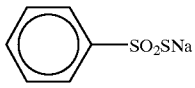
F-14
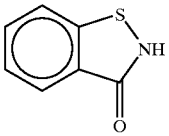
F-15
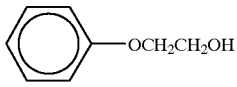
F-16
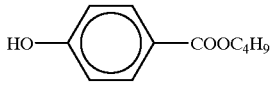
F-17
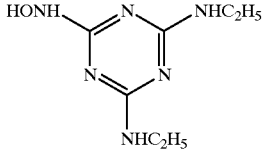
F-18

-continued

F-19

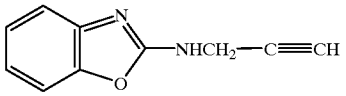

F-20

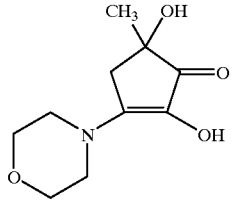

Preparation of Sample 302

Sample 302 was prepared by changing sample 301 as follows.

1) In the 14th layer, the silver iodobromide emulsion D-a was replaced with an equal silver amount of the emulsion D-b.

2) In the 13th layer, the silver iodobromide emulsion E-a was replaced with an equal silver amount of the emulsion E-b, the silver iodobromide emulsion F-a was replaced with an equal silver amount of the emulsion F-b, and the silver iodobromide emulsion G-a was replaced with an equal silver amount of the emulsion G-b.

These samples were subjected to film hardening for 14 hr at 40° C. and a relative humidity of 70%. After that, the samples were exposed for 1/100 sec through a gelatin filter SC-50 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd using the processing step and process solution composition described on page 42 of JP-A-11-153840. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The photographic properties of the processed samples were evaluated by measuring their densities through a blue filter. The sensitivity is represented by a relative value of the reciprocal of an exposure amount required to reach a density of fog density plus 0.2 (the sensitivity of the sample 301 is assumed to be 100).

Also, the increase in fog caused by oxygen in each of samples 301 and 302 was evaluated in the same manner as in Example 1. The obtained results are shown in Table 5 below.

TABLE 5

| Sample No. | Addition of $NaClO_2$ during emulsion preparation of 14th and 13th layers | Sensitivity | Increment of fog due to oxygen | Remarks |
|---|---|---|---|---|
| 301 | Not added | 100 | 0.09 | Comp. |
| 302 | Added | 100 | 0.02 | Inv. |

AS shown in Table 5, a silver halide color photographic light-sensitive material containing high-aspect-ratio tabular grains using the halogen oxoacid salt defined in the present invention could significantly improve the fog increase caused by oxygen without lowering the sensitivity.

EXAMPLE 4

Preparing Method of Emulsion H-2

An emulsion H-2 was prepared following the same procedures as for the emulsion H in Example 3, except that $2\times10^{-5}$ mol of sodium chlorite was added per mol of a silver halide after the compound RS-1 was added (addition 2).

Preparing Method of Emulsion H-3

An emulsion H-3 was prepared following the same procedures as for the emulsion H in Example 3 except that $2\times10^{-5}$ mol of sodium chlorite was added per mol of a silver halide in (addition 1) during grain formation.

Preparation of Samples 401 and 402

Samples 401 and 402 were prepared following the same procedures as for sample 301 of Example 3, except that the silver iodobromide emulsion H in the 11th layer was replaced with an equal silver amount of the emulsions H-2 and H-3, respectively.

Evaluation of Photographic Properties

Following the same procedures as in Example 3, the photographic properties of the samples subjected to film hardening, exposure, and development processing were evaluated by measuring their densities through a green filter. The sensitivity and the fog increase caused by oxygen were also evaluated in the same manner as in Example 3. Consequently, good results were obtained by both samples 401 and 402. Accordingly, the addition of the halogen oxoacid salt defined in the present invention after the end of chemical sensitization is also effective for green-sensitive emulsions, and superior results can be obtained by the addition during grain formation.

EXAMPLE 5

Preparing Method of Emulsion N-2

An emulsion N-2 was prepared following the same procedures as for the emulsion N in Example 2, except that $1.5\times10^{-5}$ mol of sodium chlorite was added per mol of a silver halide after the compound RS-1 was added.

Preparation of Sample 501

Sample 501 was made following the same procedures as for sample 301 of Example 3, except that the silver iodobromide emulsion N in the 6th layer was replaced with an equal silver amount of the emulsion N-2.

Evaluation of Photographic Properties

Following the same procedures as in Example 3, the photographic properties of the sample subjected to film hardening, exposure, and development processing were evaluated by measuring its density through a red filter. The sensitivity and the fog increase caused by oxygen were also evaluated in the same manner as in Example 3. As a consequence, good results were obtained, indicating that excellent results can be obtained by the addition of the halogen oxoacid salt defined in the present invention after grain formation.

EXAMPLE 6

Preparation of Emulsion S-1

1,300 mL of an aqueous solution containing 1.0 g of KBr and 1.1 g of gelatin-4 of Example 1 were stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by the triple jet method. After that, 6.5 g of KBr were added, and the temperature was raised to 75° C. After a ripening step was performed for 12 min, 0.0025g of sodium benzenethiosulfonate, 300 mL of an aqueous solution G-2 (containing 12.7 g of gelatin-3 of Example 1 in 100 mL) were added.

157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30. Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30. Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate, and the addition of the aqueous solution X-4 was so performed that the pAg of the bulk emulsion solution in the reaction vessel was held at 7.52.

After that, 6.9 g of disodium 4,5-dihydroxybenzene-1,3-disulfonate was added to perform reduction sensitization. Then, 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. Subsequently, 73.9 g of an AgI fine grain emulsion (containing 13.0 g of AgI fine grains having an average grain size of 0.047 $\mu$m in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution x-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4.

After that, desalting was performed by normal flocculation. Water, NaOH, and gelatin-1 described above were added under stirring, and the pH and the pAg were adjusted to 6.4 and 8.6, respectively, at 56° C.

Subsequently, spectral sensitization and chemical sensitization were performed in the same manner as in emulsion H in Example 3. That is, $5.50\times10^{-4}$, $1.30\times10^{-4}$, and $4.65\times10^{-5}$ mol of the sensitizing dyes Exs-3, EXS-4, and EXS-5 were added per mol of a silver halide. Before chemical sensitization was performed, $2\times10^{-3}$ mol of a compound ExA-1 was added per mol of a silver halide. The emulsion was optimally chemically sensitized by sequentially adding potassium thiocyanate, chloroauric acid, sodium thiosulfate, and N,N-dimethylselenourea. After that, $2\times10^{-3}$ mol of the compound RS-1 was added and then, water-soluble mercapto compounds MER-1 and MER-2 were added at a ratio of 4 : 1 such that the total amount was $3.6\times10^{-4}$ mol per mol of a silver halide.

Preparation of Emulsion S-2

Emulsion S-2 was prepared in the same manner as emulsion S-1, except that sodium chlorite in an amount of $5\times10^{-5}$ mol per mol of silver halide was added before the start of ripening when the temperature was raised to 75° C.

Preparation of Emulsion S-3

Emulsion S-3 was prepared in the same manner as emulsion S-1, except that sodium chlorite in an amount of $5\times10^{-5}$ mol per mol of silver halide was added after the addition of the AgI fine grain emulsion but before the addition of solutions Ag-4 and X-4.

Preparation of Emulsions S-4 to S-6

Emulsions S-4 to S-6 were prepared in the same manner as in emulsions S-1 to S-3, respectively, except that disodium 4,5-dihydroxybenzene-1,3-disulfonate that was used as a reduction sensitizer was replaced with 0.020 g of the compound RS-1.

Preparation of Emulsion S-7

1,300 mL of an aqueous solution containing 1.0 g of KBr and 1.1 g of gelatin-4 of Example 1 were stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by the triple jet method. After that, 6.5 g of KBr were added, and the temperature was raised to 75° C. After a ripening step was performed for 12 min, 300 mL of an aqueous solution G-2 (containing 12.7 g of gelatin-3 of Example 1 in 100 mL) was added. Subsequently, 2.1 g of disodium 4,5-dihydroxybenzene-1,3-disulfonate was added to perform reduction sensitization.

157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30. Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30. Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate, and the addition of the aqueous solution X-4 was so performed that the pAg of the bulk emulsion solution in the reaction vessel was held at 7.52.

After that, 0.0025 g of sodium benzenethiosulfonate was added and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. Subsequently, 73.9 g of an AgI fine grain emulsion (containing 13.0 g of AgI fine grains having an average grain size of 0.047 $\mu$m in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4.

After that, desalting was performed by normal flocculation. Water, NaOH, and gelatin-1 described above were added under stirring, and the pH and the pAg were adjusted to 6.4 and 8.6, respectively, at 56° C.

Subsequently, the same spectral sensitization and chemical sensitization as in emulsion S-1 were performed.

Preparation of Emulsion S-8

Emulsion S-8 was prepared in the same manner as emulsion S-7, except that sodium chlorite in an amount of $5\times10^{-5}$ mol per mol of silver halide was added after the addition of the AgI fine grain emulsion but before the addition of solutions Ag-4 and X-4.

Preparation of Samples 601 to 608

Samples 601 to 608 were prepared in the same manner as Sample 301 in Example 3, except that silver iodobromide emulsion H used in 11th layer of Sample 301 was replaced with the same silver amount of S-1 to S-8, respectively.

Evaluation of Photographic Properties

Following the same procedures as in Example 3, the photographic properties of the sample subjected to film hardening, exposure, and development processing were evaluated by measuring its density through a green filter. The sensitivity and the fog increase caused by oxygen were also evaluated in the same manner as in Example 3, assuming the sensitivity of sample 601 to be 100). The results are set forth in Table 6 below.

TABLE 6

| Sample No. | Addition of sodium chlorite | Reduction sensitizer | Sensitivity | Fog increase due to oxygen | Remarks |
|---|---|---|---|---|---|
| 601 | None | X-1 | 100 | 0.11 | Comparison |
| 602 | Before reduction sensitization in the process of grain formation | X-1 | 99 | 0.04 | Invention |
| 603 | After reduction sensitization in the process of grain formation | X-1 | 100 | 0.04 | Invention |
| 604 | None | RS-1 | 101 | 0.11 | Comparison |
| 605 | Before reduction sensitization in the process of grain formation | RS-1 | 99 | 0.05 | Invention |
| 606 | After reduction sensitization in the process of grain formation | RS-1 | 99 | 0.05 | Invention |
| 607 | None | X-1 | 100 | 0.10 | Comparison |
| 608 | After reduction sensitization in the process of grain formation | X-1 | 100 | 0.04 | Invention |

X-1) Disodium 4,5-dihydroxybenzene-1,3-disulfonate

It is apparent that when the halogen oxoacid salt defined in the present invention is used in the preparation of reduction-sensitized emulsion of the present invention, excellent advantages were obtained at both timings of before and after the reduction sensitization that is conducted during grain formation.

The present invention can provide a silver halide photographic emulsion having high sensitivity and a suppressed fog increase caused by oxygen, and a silver halide light-sensitive material using the emulsion.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising silver halide grains, wherein the emulsion was prepared by adding, at the time of grain formation and/or after the grain formation, at least one halogen oxoacid salt represented by formula (I) below:

$$M(XO_n)_m \quad (I)$$

wherein M represents an alkali metal ion or alkaline-earth metal ion; X represents a halogen atom; n represents 2 or 3; and m represents 1 or 2.

2. The silver halide photographic emulsion according to claim 1, wherein the halogen oxoacid salt is a chlorite.

3. The silver halide photographic emulsion according to claim 1, wherein 50% or more of the total projected area of all the silver halide grains contained in the emulsion is occupied by tabular silver halide grains, each having (111) faces as parallel main planes and an aspect ratio of 5 or more.

4. The silver halide photographic emulsion according to claim 2, wherein 50% or more of the total projected area of all the silver halide grains contained in the emulsion is occupied by tabular silver halide grains, each having (111) faces as parallel main planes and an aspect ratio of 5 or more.

5. The silver halide photographic emulsion according to claim 1, wherein the emulsion was reduction sensitized by at least one reduction sensitizer selected from a group consisting of (a) thiourea dioxide, (b) hydroxyamines and their derivatives, and (c) dihydroxybenzenes and their derivatives.

6. The silver halide photographic emulsion according to claim 2, wherein the emulsion was reduction sensitized by at least one reduction sensitizer selected from a group consisting of (a) thiourea dioxide, (b) hydroxyamines and their derivatives, and (c) dihydroxybenzenes and their derivatives.

7. The silver halide photographic emulsion according to claim 3, wherein the emulsion was reduction sensitized by at least one reduction sensitizer selected from a group consisting of (a) thiourea dioxide, (b) hydroxyamines and their derivatives, and (c) dihydroxybenzenes and their derivatives.

8. The silver halide photographic emulsion according to claim 4, wherein the emulsion was reduction sensitized by at least one reduction sensitizer selected from a group consisting of (a) thiourea dioxide, (b) hydroxyamines and their derivatives, and (c) dihydroxybenzenes and their derivatives.

9. A silver halide photographic light-sensitive material having at least one silver halide emulsion layer on a support, wherein the silver halide photographic emulsion according to claim 1 is contained in the at least one silver halide emulsion layer.

10. A silver halide photographic light-sensitive material having at least one silver halide emulsion layer on a support, wherein the silver halide photographic emulsion according to claim 2 is contained in the at least one silver halide emulsion layer.

11. A silver halide photographic light-sensitive material having at least one silver halide emulsion layer on a support, wherein the silver halide photographic emulsion according to claim 3 is contained in the at least one silver halide emulsion layer.

12. A silver halide photographic light-sensitive material having at least one silver halide emulsion layer on a support, wherein the silver halide photographic emulsion according to claim 4 is contained in the at least one silver halide emulsion layer.

13. A silver halide photographic light-sensitive material having at least one silver halide emulsion layer on a support, wherein the silver halide photographic emulsion according to claim 5 is contained in the at least one silver halide emulsion layer.

14. A silver halide photographic light-sensitive material having at least one silver halide emulsion layer on a support, wherein the silver halide photographic emulsion according to claim 6 is contained in the at least one silver halide emulsion layer.

15. A silver halide photographic light-sensitive material having at least one silver halide emulsion layer on a support, wherein the silver halide photographic emulsion according to claim 7 is contained in the at least one silver halide emulsion layer.

16. A silver halide photographic light-sensitive material having at least one silver halide emulsion layer on a support, wherein the silver halide photographic emulsion according to claim 8 is contained in the at least one silver halide emulsion layer.

* * * * *